US008215949B2

(12) United States Patent
Toqan

(10) Patent No.: US 8,215,949 B2
(45) Date of Patent: Jul. 10, 2012

(54) COMBUSTION STABILIZATION SYSTEMS

(76) Inventor: Majed Toqan, Scottsdale, AZ (US)

( * ) Notice: Subject to any disclaimer, the term of this patent is extended or adjusted under 35 U.S.C. 154(b) by 1292 days.

(21) Appl. No.: 11/749,710

(22) Filed: May 16, 2007

(65) Prior Publication Data

US 2007/0281253 A1 Dec. 6, 2007

Related U.S. Application Data

(60) Provisional application No. 60/747,514, filed on May 17, 2006.

(51) Int. Cl.
*F23J 7/00* (2006.01)

(52) U.S. Cl. ..... 431/4; 431/6

(58) Field of Classification Search ..... 431/4, 6, 431/42; 60/39.01, 39.464
See application file for complete search history.

(56) References Cited

U.S. PATENT DOCUMENTS

| | | | | |
|---|---|---|---|---|
| 2,750,903 | A | 6/1956 | Miller et al. | |
| 4,197,081 | A * | 4/1980 | Osborg | 431/2 |
| 4,483,137 | A * | 11/1984 | Faulkner | 60/39.55 |
| 4,643,666 | A * | 2/1987 | Green et al. | 431/4 |
| 4,752,302 | A * | 6/1988 | Bowers et al. | 44/320 |
| 5,325,795 | A | 7/1994 | Nelson et al. | |
| 5,411,394 | A | 5/1995 | Beer et al. | |
| 5,456,066 | A | 10/1995 | Smith et al. | |
| 5,480,298 | A * | 1/1996 | Brown | 431/79 |
| 5,484,476 | A | 1/1996 | Boyd | |
| 5,667,376 | A * | 9/1997 | Robertson et al. | 431/115 |
| 5,791,889 | A | 8/1998 | Gemmen et al. | |
| 5,937,772 | A | 8/1999 | Khinkis et al. | |
| 5,992,336 | A | 11/1999 | Ramme | |
| 6,234,092 | B1 * | 5/2001 | Domschke et al. | 110/238 |
| 6,250,235 | B1 | 6/2001 | Oehr et al. | |
| 6,588,213 | B2 * | 7/2003 | Newburry | 60/777 |
| 7,140,184 | B2 * | 11/2006 | Sprouse et al. | 60/743 |
| 7,162,864 | B1 * | 1/2007 | Schefer et al. | 60/286 |
| 7,503,944 | B2 * | 3/2009 | Carroll et al. | 44/354 |
| 7,513,100 | B2 * | 4/2009 | Motter et al. | 60/39.3 |
| 2002/0028170 | A1 | 3/2002 | Sudduth et al. | |
| 2003/0221409 | A1 | 12/2003 | McGowan | |
| 2004/0123786 | A1 | 7/2004 | Crafton et al. | |
| 2006/0121398 | A1 * | 6/2006 | Meffert et al. | 431/4 |
| 2007/0031768 | A1 * | 2/2007 | Schefer et al. | 431/4 |
| 2007/0082310 | A1 * | 4/2007 | Norton et al. | 431/354 |

* cited by examiner

*Primary Examiner* — Kenneth Rinehart
*Assistant Examiner* — Daniel Bernstein
(74) *Attorney, Agent, or Firm* — Stoneman Law Patent Group; Martin L. Stoneman; Eric Fish

(57) ABSTRACT

Systems for stabilizing combustion while minimizing NOx generation by using high-flame-speed additives to stabilize the flame front in combustors operating at relatively low temperatures and/or under oxygen constraints. The system is adapted for use in coal-fired boilers, oil-fired boilers, and gas turbine engines. The methods stabilize the flame front to permit stable combustion under an expanded range of part-load conditions. The system provides substantially complete combustion of coal in coal boilers resulting in ash saleable for use in concrete manufacturing.

49 Claims, 6 Drawing Sheets

COMBUSTION STABILIZATION SYSTEMS

CROSS-REFERENCE TO RELATED APPLICATION

The present application is related to and claims priority from prior provisional application Ser. No. 60/747,514, filed May 17, 2006, entitled "COMBUSTION STABILIZATION SYSTEMS", the contents of which are incorporated herein by this reference and are not admitted to be prior art with respect to the present invention by the mention in this cross-reference section.

BACKGROUND

The present invention relates to combustion stabilization systems. More particularly, the present invention relates to systems for stabilizing combustion while minimizing NOx generation. Nitrogen oxides, or NOx, is the generic term for a group of highly reactive gases, all of which contain nitrogen and oxygen in varying amounts. Many of the nitrogen oxides are colorless and odorless; however, for example, one common pollutant, nitrogen dioxide ($NO_2$) along with particles in the air can often be seen as a reddish-brown layer over many urban areas. Generally, NOx are considered to be pollutants and NOx emissions are limited and/or controlled in many countries (in the U.S.A., for example, by the Environmental Protection Agency).

More particularly, the present invention relates to systems for stabilizing combustion while minimizing NOx generation by using high-flame-speed additives to stabilize the flame front in combustors operating at low temperature and/or under oxygen constraints. Even more particularly, the present invention relates to systems for minimizing NOx emissions in coal-fired boilers. Also, the present invention relates to systems for minimizing NOx emissions in gas turbines. In addition, the present invention relates to systems for minimizing coal-boiler NOx emissions while permitting substantially complete combustion of the coal.

Typically, power generators operating at full fuel load are operated under temperature and/or oxygen constraints that lower NOx emissions but prevent complete combustion of the fuel. Typically, attempting to operate a power generator under such NOx-minimizing conditions at part fuel load causes flame destabilization and/or flame out.

No system exists that permits stable, NOx-minimizing, part-load combustion by using high-flame-speed additives to stabilize the flame front. Further, no system exists that minimizes coal-boiler NOx emissions while permitting substantially complete combustion of the coal.

Therefore, a need exists for a system that provides stable, NOx-minimizing, part-load combustion by using high-flame-speed additives to stabilize the flame front. Further, a need exists for a system that minimizes coal-boiler NOx emissions while permitting substantially complete combustion of the coal.

OBJECTS AND FEATURES OF THE INVENTION

A primary object and feature of the present invention is to provide combustion stabilization systems.

It is a further object and feature of the present invention to provide such a system that provides stable, NOx-minimizing, part-load combustion by using high-flame-speed additives to stabilize the flame front. It is another object and feature of the present invention to provide such a system that minimizes NOx emissions from coal-fired boilers. It is another object and feature of the present invention to provide such a system that minimizes NOx emissions from gas turbines.

It is a further object and feature of the present invention to provide such a system that minimizes coal-boiler NOx emissions while permitting substantially complete combustion of the coal.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a combustion stabilization system, relating to improving flame stability under NOx-minimizing combustion conditions, comprising the steps of: selecting at least one high-flame-speed additive; adding such at least one high-flame-speed additive to at least one lower-flame-speed fuel to generate at least one higher-flame-speed fuel mixture; injecting at least one part-load of such at least one higher-flame-speed fuel mixture into at least one combustion chamber having at least one combustion initiator; igniting such at least one higher-speed fuel mixture with such at least one combustion initiator; and substantially optimizing combustion conditions for such at least one higher-flame-speed fuel mixture to substantially minimize NOx emissions.

In accordance with another preferred embodiment hereof, this invention provides a combustion stabilization system, relating to improving flame stability under NOx-minimizing combustion conditions, comprising the steps of: selecting at least one high-flame-speed additive; adding such at least one high-flame-speed additive to at least one lower-flame-speed fuel to generate at least one higher-flame-speed fuel mixture; injecting such at least one higher-flame-speed fuel mixture into at least one gas turbine engine having at least one pilot flame; igniting such at least one higher-speed fuel mixture with such at least one pilot flame; extinguishing such at least one pilot flame; continuing to inject such at least one part-load of such at least one higher-flame-speed fuel mixture into such at least one gas turbine engine; and substantially optimizing combustion conditions for such at least one higher-flame-speed fuel mixture to substantially minimize NOx emissions; wherein such at least one higher-flame-speed fuel mixture continues to combust in the absence of such at least one pilot flame.

Moreover, it provides such a combustion stabilization system, wherein such step of injecting such at least one higher-flame-speed fuel mixture into at least one gas turbine engine having at least one pilot flame comprises the step of injecting at least one part-load of such at least one higher-flame-speed fuel mixture into at least one gas turbine engine having at least one pilot flame. Additionally, it provides such a combustion stabilization system, further comprising the step of preheating such at least one high-flame-speed additive prior to adding such at least one high-flame-speed additive to such at least one lower-flame-speed fuel to generate such at least one higher-flame-speed fuel mixture. Also, it provides such a combustion stabilization system, further comprising the step of preheating such at least one low-flame-speed fuel prior to adding such at least one high-flame-speed additive to such at least one lower-flame-speed fuel to generate such at least one higher-flame-speed fuel mixture. In addition, it provides such a combustion stabilization system, further comprising the step of preheating such at least one high-flame-speed additive prior to adding such at least one high-flame-speed additive to such at least one preheated lower-flame-speed fuel.

And, it provides such a combustion stabilization system, further comprising the step of atomizing such at least one high-flame-speed additive prior to adding such at least one high-flame-speed additive to such at least one lower-flame-speed fuel to generate such at least one higher-flame-speed fuel mixture. Further, it provides such a combustion stabilization system, further comprising the step of vaporizing such at least one high-flame-speed additive prior to adding such at least one high-flame-speed additive to such at least one lower-flame-speed fuel to generate such at least one higher-flame-speed fuel mixture. Even further, it provides such a combustion stabilization system, wherein such step of adding such at least one high-flame-speed additive to such at least one lower-flame-speed fuel further comprises the step of increasing the flame speed of such at least one higher-flame-speed fuel mixture by about thirty percent relative to the flame speed of such at least one lower-flame-speed fuel. Moreover, it provides such a combustion stabilization system, wherein such step of substantially optimizing combustion conditions comprises the step of reducing the amount of oxygen available to such at least one higher-flame-speed fuel mixture in at least one combustion zone of such at least one gas turbine engine.

Additionally, it provides such a combustion stabilization system, wherein such step of substantially optimizing combustion conditions comprises the step of controlling the combustion temperature of such at least one higher-flame-speed fuel mixture. Also, it provides such a combustion stabilization system, wherein such step of selecting at least one high-flame-speed additive comprises the step of selecting at least one hydrocarbon. In addition, it provides such a combustion stabilization system, wherein such step of selecting at least one hydrocarbon comprises the step of selecting at least one of the set comprising methane, ethane, propane, butanes, pentanes, hexanes, septanes, octanes, nonanes, decanes, toluene, benzene, acetone, mixtures of hydrocarbons where $C<10$, mixtures of hydrocarbons where $C<20$, diesel oil, no. 2 oil, jet fuel, acetylene, vegetable derived oils, animal derived oils, coal-based gasification products, and oil-based gasification products. And, it provides such a combustion stabilization system, wherein such step of selecting at least one hydrocarbon comprises the step of selecting at least one of the set comprising alcohols, ethers, aldehydes, and ketones. Further, it provides such a combustion stabilization system, wherein such step of selecting at least one high-flame-speed additive comprises the step of selecting hydrogen. Even further, it provides such a combustion stabilization system, wherein such step of injecting such at least one higher-flame-speed fuel mixture into such at least one gas turbine engine having such at least one pilot flame comprises the step of injecting such at least one higher-flame-speed fuel mixture into such at least one gas turbine at a throughput of about ten percent of the maximum fuel load of such at least one gas turbine engine using such at least one lower-flame-speed fuel.

Moreover, it provides such a combustion stabilization system, wherein such step of injecting such at least one higher-flame-speed fuel mixture into such at least one gas turbine engine having such at least one pilot flame comprises the step of injecting such at least one higher-flame-speed fuel mixture into such at least one gas turbine at a throughput of about twenty percent of the maximum fuel load of such at least one gas turbine engine using such at least one lower-flame-speed fuel. Additionally, it provides such a combustion stabilization system, wherein such step of injecting such at least one higher-flame-speed fuel mixture into such at least one gas turbine engine having such at least one pilot flame comprises the step of injecting such at least one higher-flame-speed fuel mixture into such at least one gas turbine at a throughput of about thirty percent of the maximum fuel load of such at least one gas turbine engine using such at least one lower-flame-speed fuel. Also, it provides such a combustion stabilization system, wherein such step of continuing to inject such at least one higher-flame-speed fuel mixture into such at least one gas turbine engine comprises the step of injecting such at least one higher-flame-speed fuel mixture into such at least one gas turbine engine at a throughput of about forty percent of the maximum fuel load of such at least one gas turbine engine using such at least one lower-flame-speed fuel.

In addition, it provides such a combustion stabilization system, further comprising the step of preheating such at least one higher-flame-speed fuel mixture to near the flash point of such at least one high-flame-speed additive prior to injecting such at least one higher-flame-speed fuel mixture into such at least one gas turbine engine having such at least one pilot flame, whereby such at least one lower-flame-speed additive atomizes such at least one high-flame-speed fuel during injection. And, it provides such a combustion stabilization system, further comprising the step of preheating such at least one higher-flame-speed fuel mixture to near the flash point of such at least one high-flame-speed additive prior to continuing to inject such at least one higher-flame-speed fuel mixture into such at least one gas turbine engine, whereby such at least one low-flame-speed fuel atomizes such at least one higher-flame-speed fuel during injection.

Further, it provides such a combustion stabilization system, further comprising the step of using such at least one high-flame-speed additive substantially exclusively during start-up of such at least one gas turbine engine and using such at least one higher-speed fuel mixture after start-up of such at least one gas turbine engine.

Even further, it provides such a combustion stabilization system, wherein such at least one high-flame-speed additive is preheated to near flash point and is injected through the primary gas fuel nozzles of such at least one gas turbine engine. Moreover, it provides such a combustion stabilization system, wherein such at least one high-flame-speed additive is preheated to near flash point and is injected through the primary fuel oil nozzles of such at least one gas turbine engine. Additionally, it provides such a combustion stabilization system, wherein such at least one high-flame-speed additive is preheated to near flash point and is injected through the pilot nozzle of such at least one gas turbine engine. Additionally, it provides such a combustion stabilization system, wherein such at least one high-flame-speed additive is preheated to near flash point and is injected through the premix gas fuel nozzles of such at least one gas turbine engine. Also, it provides such a combustion stabilization system, wherein such at least one higher-flame-speed fuel is preheated to near flash point and is injected through the premix gas fuel nozzles of such at least one gas turbine engine. Also, it provides such a combustion stabilization system, further comprising the step of evenly distributing such at least one higher-speed fuel mixture among the plurality of fuel nozzles that feed the annular combustors and the can annular combustors of such at least one gas turbine engine. In addition, it provides such a combustion stabilization system, further comprising the step of substantially eliminating cold spots in the combustor of such at least one gas-turbine engine.

And, it provides such a combustion stabilization system, further comprising the step of reducing CO emissions by at least about thirty percent from the CO emissions of such at least one gas turbine engine using only such at least one lower-flame-speed fuel. Further, it provides such a combustion stabilization system, further comprising the steps of: substantially eliminating temperature zones less than about one thousand two hundred degrees Celsius in the combustor of such at least one gas-turbine engine; substantially eliminating flame quenching in the combustor of such at least one gas-turbine engine; and substantially eliminating CO emissions from such at least one gas-turbine engine; during part-load operations, relative to the operating conditions of such at least one gas turbine engine using only such at least one lower-flame-speed fuel during part-load operations. Even further, it provides such a combustion stabilization system, further comprising the step of generating CO emissions from such at least one gas turbine engine of a sufficiently low concentration that a CO selective catalytic reduction system is not legally required.

In accordance with another preferred embodiment hereof, this invention provides a combustion stabilization system, comprising the steps of: substantially optimizing combustion conditions for at least one first coal fuel mixture to substantially minimize NOx emissions; burning such at least one first coal fuel mixture under such substantially NOx minimizing conditions; collecting at least one first coal-combustion byproduct generated by such NOx-minimizing burning; selecting at least one high-flame-speed additive; adding such at least one high-flame-speed additive to such at least one first coal-combustion byproduct to generate at least one higher-flame-speed fuel mixture; substantially optimizing combustion conditions for such at least one higher-flame-speed fuel mixture to maximize combustion of such at least one higher-flame-speed fuel mixture; injecting such at least one higher-flame-speed fuel mixture into at least one combustion chamber having at least one combustion initiator; igniting such at least one higher-speed fuel mixture with such at least one combustion initiator; burning such at least one higher-flame-speed fuel mixture under such substantially combustion maximizing conditions; and collecting at least one second coal-combustion byproduct generated by such combustion-maximizing burning.

Moreover, it provides such a combustion stabilization system, wherein such step of injecting such at least one higher-flame-speed fuel mixture into at least one combustion chamber having at least one combustion initiator comprises the step of injecting at least one part-load of such at least one higher-flame-speed fuel mixture into at least one combustion chamber having at least one combustion initiator. Additionally, it provides such a combustion stabilization system, further comprising the step of selling such at least one second coal-combustion byproduct for use in cement manufacturing. Also, it provides such a combustion stabilization system, further comprising the step of adding urea to such at least one first coal-combustion byproduct prior to the step of collecting such at least one first coal-combustion byproduct generated by such NOx-minimizing burning. In addition, it provides such a combustion stabilization system, further comprising the step of adding ammonia to such at least one first coal-combustion byproduct prior to the step of collecting such at least one first coal-combustion byproduct generated by such NOx-minimizing burning.

And, it provides such a combustion stabilization system, further comprising the step of adding calcium to such at least one first coal-combustion byproduct prior to the step of burning such at least one higher-flame-speed fuel mixture under such substantially combustion maximizing conditions. Further, it provides such a combustion stabilization system, further comprising the step of adding magnesium to such at least one first coal-combustion byproduct prior to the step of burning such at least one higher-flame-speed fuel mixture under such substantially combustion maximizing conditions. Even further, it provides such a combustion stabilization system, further comprising the step of adding iron to such at least one first coal-combustion byproduct prior to the step of burning such at least one higher-flame-speed fuel mixture under such substantially combustion maximizing conditions. Moreover, it provides such a combustion stabilization system, wherein the step of selecting at least one high-flame-speed additive comprises the step of selecting at least one second coal fuel mixture.

Additionally, it provides such a combustion stabilization system, wherein the step of adding such at least one high-flame-speed additive to such at least one first coal-combustion byproduct to generate at least one higher-flame-speed fuel mixture comprises the step of adding such at least one second coal fuel mixture to such at least one first coal-combustion byproduct to generate at least one higher-flame-speed fuel mixture. Also, it provides such a combustion stabilization system, wherein the step of injecting such at least one higher-flame-speed fuel mixture into such at least one combustion chamber having such at least one combustion initiator comprises the step of injecting such at least one first coal-combustion byproduct and such at least one second coal fuel mixture into such at least one combustion chamber having such at least one combustion initiator.

In addition, it provides such a combustion stabilization system, wherein such at least one first coal-combustion byproduct and such at least one high-flame-speed additive comprise about at least one 1:10 ratio or less by mass. And, it provides such a combustion stabilization system, wherein such at least one first coal-combustion byproduct and such at least one high-flame-speed additive comprise about at least one 1.5:10 ratio by mass. Further, it provides such a combustion stabilization system, wherein such at least one first coal-combustion byproduct and such at least one high-flame-speed additive comprise about at least one 2:10 ratio by mass. Even further, it provides such a combustion stabilization system, wherein such at least one first coal-combustion byproduct and such at least one high-flame-speed additive comprise about at least one 2.5:10 ratio by mass. Moreover, it provides such a combustion stabilization system, wherein such at least one first coal-combustion byproduct and such at least one high-flame-speed additive comprise about at least one 3:10 ratio by mass. Additionally, it provides such a combustion stabilization system, wherein such at least one first coal-combustion byproduct and such at least one high-flame-speed additive comprise about at least one 3.5:10 ratio by mass. Also, it provides such a combustion stabilization system, wherein such at least one first coal-combustion byproduct and such at least one high-flame-speed additive comprise about at least one 4:10 ratio by mass. In addition, it provides such a combustion stabilization system, wherein such at least one first coal-combustion byproduct and such at least one high-flame-speed additive comprise at least one 4.5:10 ratio by mass.

And, it provides such a combustion stabilization system, wherein such step of burning such at least one first coal fuel mixture under such substantially NOx minimizing conditions comprises the step of burning such at least one first coal fuel mixture in at least one atmosphere comprising about three percent oxygen at exit. Further, it provides such a combustion stabilization system, wherein such step of burning such at least one higher-flame-speed fuel mixture under such substantially combustion maximizing conditions comprises the step of burning such at least one higher-flame-speed fuel mixture in at least one atmosphere comprising about four percent oxygen at exit. Even further, it provides such a combustion stabilization system, wherein such step of burning such at least one higher-flame-speed fuel mixture under such substantially combustion maximizing conditions comprises the step of burning such at least one higher-flame-speed fuel mixture in at least one atmosphere comprising about five percent oxygen at exit. Moreover, it provides such a combustion stabilization system, wherein such step of burning such at least one higher-flame-speed fuel mixture under such substantially combustion maximizing conditions comprises the step of burning such at least one higher-flame-speed fuel mixture in at least one atmosphere comprising about six percent oxygen at exit.

Additionally, it provides such a combustion stabilization system, wherein such at least one second coal-combustion byproduct comprises less than about five percent carbon by mass. Also, it provides such a combustion stabilization system, wherein such at least one second coal-combustion byproduct comprises less than about four percent carbon by mass. In addition, it provides such a combustion stabilization system, wherein such at least one second coal-combustion byproduct comprises less than about three percent carbon by mass. And, it provides such a combustion stabilization system, wherein such at least one second coal-combustion byproduct comprises less than about two percent carbon by mass. Further, it provides such a combustion stabilization system, wherein such at least one second coal-combustion byproduct comprises less than about one percent carbon by mass.

Even further, it provides such a combustion stabilization system, wherein such step of injecting such at least one higher-flame-speed fuel mixture into such at least one combustion chamber having such at least one combustion initiator comprises the step of injecting such at least one higher-flame-speed fuel mixture into such at least one combustion chamber adjacent at least one highest-temperature region of such at least one combustion chamber. Moreover, it provides such a combustion stabilization system, wherein such step of injecting such at least one higher-flame-speed fuel mixture into such at least one combustion chamber having such at least one combustion initiator comprises the step of injecting such at least one higher-flame-speed fuel mixture into such at least one combustion chamber adjacent at least one highest-oxygen content region of such at least one combustion chamber. Additionally, it provides such a combustion stabilization system, wherein such step of injecting such at least one higher-flame-speed fuel mixture into such at least one combustion chamber having such at least one combustion initiator comprises the step of injecting such at least one higher-flame-speed fuel mixture into such at least one combustion chamber prior to such at least one first coal-combustion byproduct cooling to ambient temperature from such NOx-minimizing burning temperature.

Also, it provides such a combustion stabilization system, wherein such at least one first coal-combustion byproduct comprises at least one fly ash and at least one bottom ash. In addition, it provides such a combustion stabilization system, wherein such step of burning such at least one first coal fuel mixture under such substantially NOx minimizing conditions and such step of burning such at least one higher-flame-speed fuel mixture under such substantially combustion maximizing conditions both occur in such at least one combustion chamber at different times. And, it provides such a combustion stabilization system, further comprising the step of transferring at least one unused NOx emission credit. Further, it provides such a combustion stabilization system, further comprising the step of steam treating such at least one first coal-combustion byproduct. Even further, it provides such a combustion stabilization system, wherein such step of adding such at least one high-flame-speed additive to such at least one first coal-combustion byproduct comprises the step of steam treating such at least one first coal-combustion byproduct.

Even further, it provides such a combustion stabilization system, wherein such step of selecting at least one high-flame-speed additive comprises the step of selecting at least one hydrocarbon. Even further, it provides such a combustion stabilization system, wherein such step of selecting at least one hydrocarbon comprises the step of selecting at least one of the set comprising methane, ethane, propane, butanes, pentanes, hexanes, septanes, octanes, nonanes, decanes, toluene, benzene, acetone, mixtures of hydrocarbons where C<10, mixtures of hydrocarbons where C<20, diesel oil, no. 2 oil, heavy oil, jet fuel, naphta, acetylene, bio derived oils, coal gasification products, and oil gasification products. Even further, it provides such a combustion stabilization system, wherein such step of selecting at least one hydrocarbon comprises the step of selecting at least one of the set comprising at least one of alcohols, ethers, aldehydes, and ketones. Even further, it provides such a combustion stabilization system, wherein such step of selecting at least one high-flame-speed additive comprises the step of selecting hydrogen.

Even further, it provides such a combustion stabilization system, further comprising the step of reducing milling of such at least one first coal fuel mixture prior to burning such at least one first coal fuel mixture under such substantially NOx minimizing conditions in anticipation of burning such at least one higher-flame-speed fuel mixture under such substantially combustion maximizing conditions The combustion stabilization system, further comprising the step of reducing milling of at least one portion of such at least one higher-flame-speed fuel mixture prior to burning such at least one higher-flame-speed fuel mixture under such substantially combustion maximizing conditions. Even further, it provides such a combustion stabilization system, further comprising the step of reducing milling of at least one portion of such at least one first coal-combustion byproduct prior to burning such at least one first coal-combustion byproduct under such substantially combustion maximizing conditions.

Even further, it provides such a combustion stabilization system, further comprising the steps of reducing milling of such at least one first coal fuel mixture prior to burning such at least one first coal fuel mixture under such substantially NOx minimizing conditions; milling such at least one first coal-combustion byproduct; and burning such at least one first coal-combustion byproduct under such substantially combustion maximizing conditions. Even further, it provides such a combustion stabilization system, wherein mill electrical consumption is reduced by about twenty percent per ton of such at least one first coal fuel mixture.

Even further, it provides such a combustion stabilization system, wherein such step of injecting such at least one higher-flame-speed fuel mixture into such at least one combustion chamber having such at least one combustion initiator comprises the step of adding such at least one high-flame-speed additive to such at least one first coal-combustion byproduct to generate at least one higher-flame-speed fuel mixture. Even further, it provides such a combustion stabilization system, wherein such at least one first coal-combustion byproduct comprises at least about five percent carbon by mass. Even further, it provides such a combustion stabilization system, wherein such at least one first coal-combustion byproduct comprises at least about ten percent carbon by mass. Even further, it provides such a combustion stabilization system, wherein such at least one first coal-combustion byproduct comprises at least about fifteen percent carbon by mass. Even further, it provides such a combustion stabilization system, wherein such at least one first coal-combustion byproduct comprises at least about twenty percent carbon by mass.

Even further, it provides such a combustion stabilization system, wherein the step of burning such at least one first coal fuel mixture under such substantially NOx minimizing conditions occurs during substantially high-load (between about 70% and about 100% of maximum load) operations of such at least one at least one combustion chamber and such step of burning such at least one higher-flame-speed fuel mixture under such substantially combustion maximizing conditions occurs during part-load (below about 70% of maximum load) conditions of such at least one combustion chamber. Even further, it provides such a combustion stabilization system, wherein such at least one combustion chamber comprises at least one coal-fired boiler.

Even further, it provides such a combustion stabilization system comprising each and every novel feature, element, combination, step and/or method disclosed or suggested by this disclosure.

DETAILED DESCRIPTION OF THE BEST MODES AND PREFERRED EMBODIMENTS OF THE INVENTION

Figure 1:
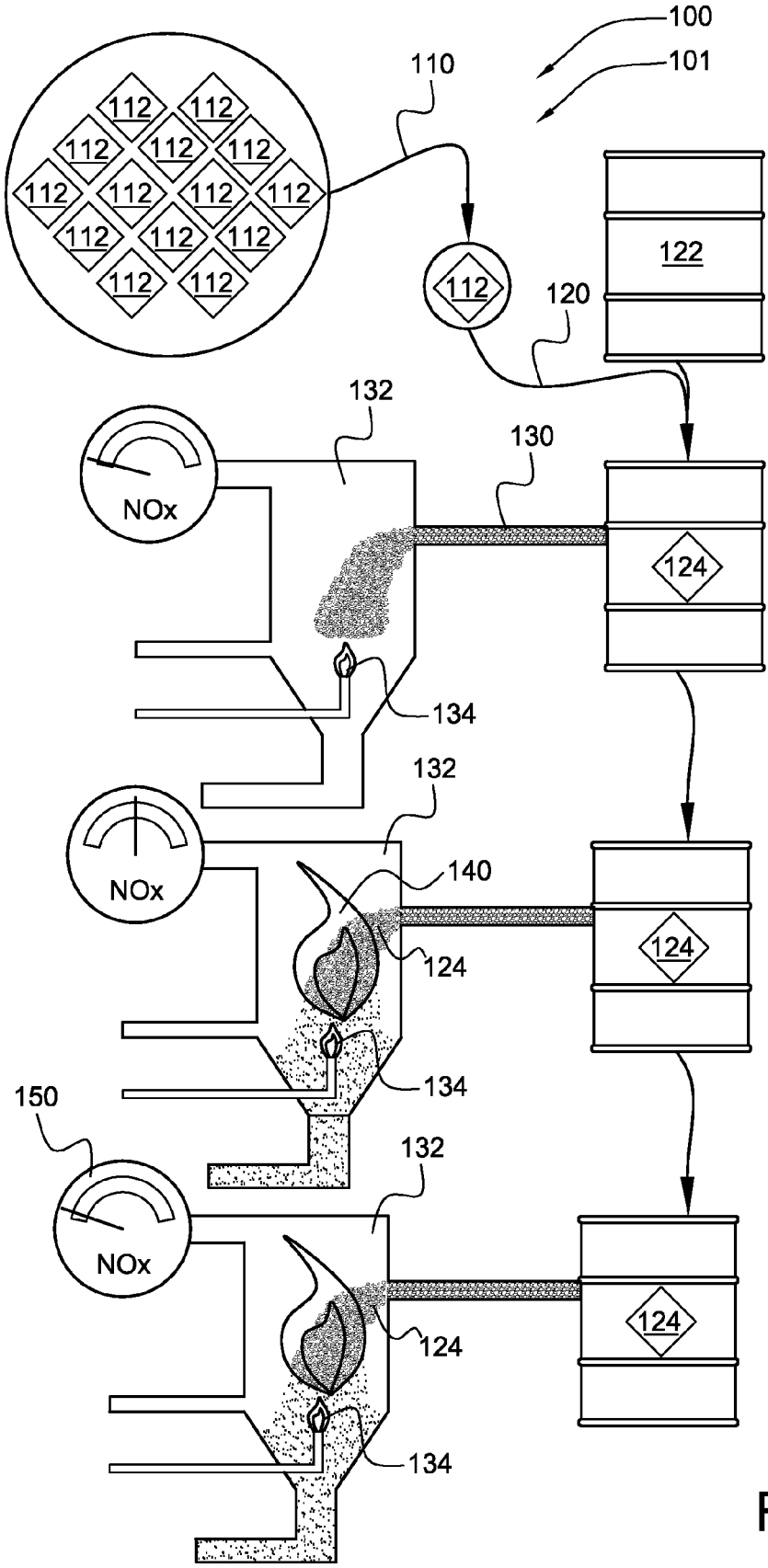
FIG. 1 shows a diagram illustrating a combustion stabilization method according to a preferred embodiment of the present invention.

FIG. 1 shows a diagram illustrating combustion stabilization method 101 according to a preferred embodiment of the present invention. Preferably, combustion stabilization system 100 comprises combustion stabilization method 101, as shown. Combustion stabilization method 101 improves flame stability under part-load, NOx-minimizing combustion conditions as well as under operating conditions that use lower reactivity fuels. Combustion stabilization method 101 permits NOx-minimizing combustion conditions to be used on an expanded range of part-load combustion operations.

Preferably, combustion stabilization method 101 comprises the steps of: selecting (step 110) at least one high-flame-speed additive 112; adding (step 120) high-flame-speed additive 112 to at least one lower-flame-speed fuel 122 to generate at least one higher-flame-speed fuel mixture 124; injecting (step 130) at least one part-load of higher-flame-speed fuel mixture 124 into at least one combustion chamber 132 having at least one combustion initiator 134 (at least embodying herein wherein such step of injecting such at least one higher-flame-speed fuel mixture into at least one combustion chamber having at least one combustion initiator comprises the step of injecting at least one part-load of such at least one higher-flame-speed fuel mixture into at least one combustion chamber having at least one combustion initiator); igniting (step 140) higher-speed fuel mixture 124 with combustion initiator 134; and substantially optimizing combustion conditions (step 150) for higher-flame-speed fuel mixture 124 to substantially minimize NOx emissions, as shown (at least embodying herein the steps of selecting at least one high-flame-speed additive; adding such at least one high-flame-speed additive to at least one lower-flame-speed fuel to generate at least one higher-flame-speed fuel mixture; injecting at least one part-load of such at least one higher-flame-speed fuel mixture into at least one combustion chamber having at least one combustion initiator; igniting such at least one higher-speed fuel mixture with such at least one combustion initiator; and substantially optimizing combustion conditions for such at least one higher-flame-speed fuel mixture to substantially minimize NOx emissions). Upon reading the teachings of this specification, those with ordinary skill in the art will now understand that, under appropriate circumstances, considering such issues as advances in technology, user preference, etc., other steps, such as injecting a full load instead of a part load, optimizing combustion conditions to control other pollutants, controlling the proportion of high-speed additive used in real-time, etc., may suffice.

Preferably, high-flame-speed additive 112 has a higher flame speed than lower-flame-speed fuel 122. Preferably, high-flame-speed additive 112 is selected at least partially for the criteria of having a higher flame speed than lower-flame-speed fuel 122, on a case-by-case basis. Other preferred high-flame-speed additive 112 selection criteria include alternately preferably cost, alternately preferably availability, alternately preferably ease of mixing with lower-flame-speed fuel 122, and alternately preferably compatibility with combustion chamber 132 and other equipment.

Preferably, lower flame speed fuel 122 comprises at least one hydrocarbon-containing composition. More preferably, lower flame speed fuel 122 comprises coal. More preferably, lower flame speed fuel 122 comprises liquid hydrocarbon fuel. More preferably, lower flame speed fuel 122 comprises gaseous hydrocarbon fuel. Upon reading the teachings of this specification, those with ordinary skill in the art will now understand that, under appropriate circumstances, considering such issues as advances in technology, user preference, fuel availability, etc., other relatively inflammable fuels, such as inerted natural gas, water-containing fuels, steam-atomized fuels, etc., may suffice.

Also, preferably, high-flame-speed additive 112 comprises at least one member of a set of compounds comprising alcohols, ethers, aldehydes, and ketones. Alternately, high-flame-speed additive 112 comprises preferably methane, alternately preferably ethane, alternately preferably propane, alternately preferably butanes, alternately preferably pentanes, alternately preferably hexanes, alternately preferably septanes, alternately preferably octanes, alternately preferably nonanes, alternately preferably decanes, alternately preferably toluene, alternately preferably benzene, alternately preferably acetone, alternately preferably mixtures of hydrocarbons where $C<10$, alternately preferably mixtures of hydrocarbons where $C<20$, alternately preferably diesel oil, alternately preferably no. 2 oil, alternately preferably jet fuel, alternately preferably acetylene, alternately preferably bio derived oils, alternately preferably naphta, alternately preferably coal-based gasification products, and alternately preferably oil-based gasification products. In an alternative preferred embodiment, high-flame-speed additive 112 comprises hydrogen. Upon reading the teachings of this specification, those with ordinary skill in the art will now understand that, under appropriate circumstances, considering such issues as advances in technology, user preference, type of lower flame speed fuel, economics, environmental regulations, etc., other lower flame speed fuels, such as biomass, wood waste, etc., may suffice.

Preferably, high-flame-speed additive 112 is added to lower flame speed fuel 122 during combustion, preferably each at the same time, preferably through the same injection port of combustion chamber 132.

In an alternative preferred embodiment, high-flame-speed additive 112 is added to lower flame speed fuel 122 prior to combustion, as shown. Preferably, high-flame-speed additive 112 and lower flame speed fuel 122 are mixed before injection into combustion chamber 132, as shown. Preferably, high-flame-speed additive 112 and lower flame speed fuel 122 are mixed and stored before injection into combustion chamber 132, as shown. Preferably, high-flame-speed additive 112 and lower flame speed fuel 122 are mixed during injection into combustion chamber 132. Preferably, high-flame-speed additive 112 and lower flame speed fuel 122 are injected into combustion chamber 132 at the same time, preferably through the same injection port. Preferably, high-flame-speed additive 112 and lower flame speed fuel 122 are injected into combustion chamber 132 at the same time through different injection ports aimed to commingle high-flame-speed additive 112 and lower flame speed fuel 122 prior to combustion. xxx Each combustion chamber 132 has at least one full fuel load (i.e., most preferred fuel load and/or most efficient fuel load and/or customary fuel load and/or maximum fuel load), hereinafter referred to as full-load, for any particular lower flame speed fuel 122. Each combustion chamber 132 is operable with less than about seventy percent of the mass of full-load of any particular lower flame speed fuel 122, such fuel load hereinafter referred to as part-load.

Preferably, for the purposes of the present patent application, all loads are calculated from the mass of lower flame speed fuel 122 being injected into combustion chamber 132 relative to the full-load of such lower flame speed fuel 122 in combustion chamber 132. Preferably, for the purposes of the present patent application, where higher-speed fuel mixture 124 is being injected into combustion chamber 132, the load percentage is calculated only from the mass of lower flame speed fuel 122 that is contained in higher-speed fuel mixture 124.

Preferably, combustion chamber 132 comprises at least one boiler combustor 480, as shown in FIG. 3. Preferably, combustion chamber 132 comprises at least one gas turbine combustor, as shown in FIG. 2. Alternately preferably, combustion chamber 132 (at least embodying herein the step of wherein such at least one at least one combustion chamber comprises at least one coal-fired boiler) comprises at least one coal-fired boiler combustor 480, as shown in FIG. 3. Upon reading the teachings of this specification, those with ordinary skill in the art will now understand that, under appropriate circumstances, considering such issues as advances in technology, user preference, etc., other combustion chambers, such as furnaces, industrial process heaters, etc., may suffice.

Preferably, combustion initiator 134 comprises at least one pilot light, as shown in FIG. 2. Alternately, combustion initiator 134 preferably comprises at least one spark generator. Alternately, combustion initiator 134 preferably comprises at least one heated electrical filament. Preferably, combustion initiator 134 does not include a preexisting stable flame front from combustion of lower flame speed fuel 122. Upon reading the teachings of this specification, those with ordinary skill in the art will now understand that, under appropriate circumstances, considering such issues as advances in technology, user preference, etc., other combustion initiators, such as chemical reactions, explosives, neighboring flame fronts, etc., may suffice.

Preferably, lower flame speed fuel 122, high-flame-speed additive 112, and/or higher-speed fuel mixture 124 are injected into combustion chamber 132 through at least one fuel nozzle of combustion chamber 132. Preferably, lower flame speed fuel 122, high-flame-speed additive 112, and/or higher-speed fuel mixture 124 are injected into combustion chamber 132 through at least one fuel port of combustion chamber 132, as shown. Preferably, lower flame speed fuel 122, high-flame-speed additive 112, and/or higher-speed fuel mixture 124 are injected into combustion chamber 132 through at least one burner of combustion chamber 132.

Preferably, combustion initiator 134 ignites injected higher-speed fuel mixture 124, as shown. Preferably, higher-speed fuel mixture 124 is continuously injected into combustion chamber 132. Preferably, higher-speed fuel mixture 124 is arranged and adapted to burn with a stable flame front. Preferably, higher-speed fuel mixture 124 is arranged and adapted to combust with a stable flame at less than about fifty percent load. Preferably, higher-speed fuel mixture 124 is arranged and adapted to combust with a stable flame at less than about forty percent load. Preferably, higher-speed fuel mixture 124 is arranged and adapted to combust with a stable flame at less than about thirty percent load. Preferably, higher-speed fuel mixture 124 is arranged and adapted to combust with a stable flame at less than about twenty percent load. Preferably, higher-speed fuel mixture 124 is arranged and adapted to combust with a stable flame at less than about ten percent load.

Typically, NOx emissions are lowered by maintaining combustion temperatures below about twenty-eight hundred degrees Fahrenheit. Preferably, NOx emissions are lowered by maintaining combustion temperatures below about twenty-seven hundred degrees Fahrenheit. Typically, combustion temperatures are controlled by artificially lowering the level of oxygen concentration in at least one portion of combustion chamber 132 in order to slow combustion. Typically, combustion temperatures are controlled by artificially lowering the level of oxygen in at least one portion of the flame in order to slow combustion. Typically, combustion temperatures are controlled by steam injection. Typically, combustion temperatures are controlled by combustion staging. Preferably, NOx emissions generated during use of combustion stabilization method 101 are lowered by utilizing a plurality of methods in concert. Upon reading the teachings of this specification, those with ordinary skill in the art will now understand that, under appropriate circumstances, considering such issues as advances in technology, user preference, boiler design, fuel type, etc., other NOx emissions reducers, such as other temperature control methods, other oxygen control methods, other chemical reactants, etc., may suffice.

Preferably, where lower flame speed fuel 122 comprises coal, NOx emissions are lowered by maintaining the level of oxygen exiting combustion chamber 132 below about six percent, preferably below about five percent, preferably below about four percent, preferably below about three percent.

FIG. 2 shows a diagram illustrating combustion stabilization method 201 according to another preferred embodiment of the present invention. Preferably, combustion stabilization system 100 comprises combustion stabilization method 201, as shown. Preferably, combustion stabilization method 201 improves flame stability under part-load, NOx-minimizing combustion conditions in gas turbine engines. Preferably, combustion stabilization method 201 permits NOx-minimizing combustion conditions to be used on an expanded range of part-load conditions in gas turbine engines 232.

Preferably, high-flame-speed additive 112 comprises high-flame-speed additive 2112, as shown. Preferably, lower-flame-speed fuel 122 comprises lower-flame-speed fuel 2122, as shown. Preferably, higher-flame-speed fuel mixture 124 comprises higher-flame-speed fuel mixture 2124, as shown. Preferably, combustion chamber 132 comprises combustion chamber 2132, as shown. Preferably, combustion initiator 134 comprises combustion initiator 2134, as shown.

Preferably, combustion stabilization method 201 comprises the steps of: selecting (step 210) at least one high-flame-speed additive 2112; adding (step 220) such high-flame-speed additive 2112 to at least one lower-flame-speed fuel 2122 to generate at least one higher-flame-speed fuel mixture 2124; injecting (step 230) higher-flame-speed fuel mixture 2124 into at least one combustion chamber 2132 (preferably, combustion chamber 2132 comprises at least one gas turbine engine 232) having at least one combustion initiator 2134 (preferably, combustion initiator 2134 comprises at least one pilot flame 234) (at least embodying herein the step of injecting such at least one higher-flame-speed fuel mixture into at least one gas turbine engine having at least one pilot flame); igniting (step 240) higher-speed fuel mixture 2124 with combustion initiator 2134 (at least embodying herein the step of igniting such at least one higher-speed fuel mixture with such at least one pilot flame); extinguishing (step 245) combustion initiator 2134 (at least embodying herein the step of extinguishing such at least one pilot flame); continuing to inject (step 248) higher-flame-speed fuel mixture 2124 into combustion chamber 2132 (at least embodying herein the step of continuing to inject such at least one part-load of such at least one higher-flame-speed fuel mixture into such at least one gas turbine engine); and substantially optimizing combustion conditions (step 250) for higher-flame-speed fuel mixture 2124 to substantially minimize NOx emissions, wherein higher-flame-speed fuel mixture 2124 continues to combust in the absence of combustion initiator 2134 (at least embodying herein the step of wherein such at least one higher-flame-speed fuel mixture continues to combust in the absence of such at least one pilot flame), as shown. Preferably, combustion initiator 2134 is extinguishable while maintaining flame stability at or below about 40% part-load, preferably at or below about 30% part-load. Upon reading the teachings of this specification, those with ordinary skill in the art will now understand that, under appropriate circumstances, considering such issues as advances in technology, user preference, type of boiler, type of fuel, etc., other steps, such as injecting a full load, injecting a part load, optimizing combustion conditions to control other pollutants, controlling the proportion of high-speed additive used in real-time, etc., may suffice.

Higher-flame-speed fuel mixture 2124 bums with a stable flame front permitting combustion initiator 2134 to be extinguished after combustion is initiated (under either full load or in an expanded range of part load conditions), resulting in cost savings to the operator.

Preferably, the step of injecting (step 230) higher-flame-speed fuel mixture 2124 into combustion chamber 2132 having combustion initiator 2134 comprises the step of injecting (step 231) at least one part-load of higher-flame-speed fuel mixture 2124 into combustion chamber 2132 having combustion initiator 2134, as shown (at least embodying herein the step of wherein such step of injecting such at least one higher-flame-speed fuel mixture into at least one gas turbine engine having at least one pilot flame comprises the step of injecting at least one part-load of such at least one higher-flame-speed fuel mixture into at least one gas turbine engine having at least one pilot flame). Preferably, higher-flame-speed fuel mixture 2124 burns with a stable flame front permitting higher-flame-speed fuel mixture 2124 to be burned under NOx minimizing conditions in an expanded range of part-load conditions (preferably, at least between about ten percent part load and about seventy percent part load, as discussed in connection with FIG. 1).

Preferably, combustion stabilization method 201 comprises the step of preheating (step 256) higher-flame-speed fuel mixture 2124 to a temperature of between about 50 C to about 260 C, near or even exceeding the flash point of high-flame-speed additive 2112, prior to injecting higher-flame-speed fuel mixture 2124 into combustion chamber 2132 having combustion initiator 2134, as shown, whereby high-flame-speed additive 2112 is atomized by lower-flame-speed fuel 2122 during injection (at least embodying herein the step of preheating such at least one higher-flame-speed fuel mixture to near the flash point of such at least one high-flame-speed additive prior to injecting such at least one higher-flame-speed fuel mixture into such at least one gas turbine engine having such at least one pilot flame, whereby such at least one high-flame-speed additive is atomized by such at least one lower-flame-speed fuel during injection). Preferably, combustion stabilization method 201 comprises the step of preheating (step 258) higher-flame-speed fuel mixture 2124 to near or even exceeding the flash point of high-flame-speed additive 2112 prior to continuing to inject higher-flame-speed fuel mixture 2124 into combustion chamber 2132, as shown, whereby low-flame-speed fuel 2122 atomizes high-flame-speed fuel additive 2112 during injection(at least embodying herein the step of preheating such at least one higher-flame-speed fuel mixture to near the flash point of such at least one high-flame-speed additive prior to continuing to inject such at least one higher-flame-speed fuel mixture into such at least one gas turbine engine, whereby such at least one high-flame-speed additive atomizes such at least one lower-flame-speed fuel during injection). Preferably, using low-flame-speed fuel 2122 to atomize high-flame-speed fuel additive 2112 extends the turn down ratio for the atomizers enabling atomization to occur over an extended range of low-flame-speed fuel 2122 injection pressures because the mixture is more flammable than air-atomized or steam-atomized high-flame-speed fuel additive 2112.

Preferably, combustion stabilization method 201 comprises the step of preheating (step 270) high-flame-speed additive 2112 prior to adding high-flame-speed additive 2112 to lower-flame-speed fuel 2122 to generate higher-flame-speed fuel mixture 2124, as shown (at least embodying herein the step of preheating such at least one high-flame-speed additive prior to adding such at least one high-flame-speed additive to such at least one lower-flame-speed fuel to generate such at least one higher-flame-speed fuel mixture). Preferably, combustion stabilization method 201 comprises the step of preheating (step 272) low-flame-speed fuel 2122 prior to adding high-flame-speed additive 2112 to lower-flame-speed fuel 2122 to generate higher-flame-speed fuel mixture 2124, as shown(at least embodying herein the step of preheating such at least one low-flame-speed fuel prior to adding such at least one high-flame-speed additive to such at least one lower-flame-speed fuel to generate such at least one higher-flame-speed fuel mixture). Preferably, combustion stabilization method 201 comprises the step of preheating (step 274) high-flame-speed additive 2112 prior to adding high-flame-speed additive 2112 to preheated lower-flame-speed fuel 2122, as shown, to insure that high-flame-speed additive 2112 does not condense in the lines leading to the fuel nozzle (at least embodying herein the step of preheating such at least one high-flame-speed additive prior to adding such at least one high-flame-speed additive to such at least one preheated lower-flame-speed fuel). Preferably, combustion stabilization method 201 comprises the step of atomizing (step 276) high-flame-speed additive 2112 prior to adding high-flame-speed additive 2112 to lower-flame-speed fuel 2122 to generate higher-flame-speed fuel mixture 2124, as shown (at least embodying herein the step of atomizing such at least one high-flame-speed additive prior to adding such at least one high-flame-speed additive to such at least one lower-flame-speed fuel to generate such at least one higher-flame-speed fuel mixture). Preferably, combustion stabilization method 201 comprises the step of vaporizing (step 278) high-flame-speed additive 2112 prior to adding high-flame-speed additive 2112 to lower-flame-speed fuel 2122 to generate higher-flame-speed fuel mixture 2124, as shown (at least embodying herein the step of vaporizing such at least one high-flame-speed additive prior to adding such at least one high-flame-speed additive to such at least one lower-flame-speed fuel to generate such at least one higher-flame-speed fuel mixture). Preferably, preheating low-flame-speed fuel 2122 and/or preheating, atomizing, and/or vaporizing high-flame-speed additive 2112 assists in volatilizing high-flame-speed additive 2112 in order to promote immediate and stable combustion. Preferably, high-flame-speed additive 2112 volatilizes and burns adjacent low-flame-speed fuel 2122, heating low-flame-speed fuel 2122 and assisting in the complete combustion of low-flame-speed fuel 2122.

Preferably, the step of adding (step 220) such at least one high-flame-speed additive 2112 to such at least one lower-flame-speed fuel 2122 further comprises the step of increasing (step 222) the flame speed of higher-flame-speed fuel mixture 2124 by at least about thirty percent relative to the flame speed of lower-flame-speed fuel 2122, as shown (at least embodying herein the step of wherein such step of adding such at least one high-flame-speed additive to such at least one lower-flame-speed fuel further comprises the step of increasing the flame speed of such at least one higher-flame-speed fuel mixture by about thirty percent relative to the flame speed of such at least one lower-flame-speed fuel). Preferably, the increased flame speed of high-flame-speed additive 2112 stabilizes the flame under low-temperature (under about twenty-five hundred degrees) and/or low oxygen conditions (under about twelve percent oxygen at exit, for gas turbine engines). Upon reading the teachings of this specification, those with ordinary skill in the art will now understand that, under appropriate circumstances, considering such issues as advances in technology, user preference, type of boiler, type of burner, type of fuel, etc., other flame speed increases, such as five percent, ten percent, fifty percent, one hundred percent, etc., may suffice.

Preferably, the step of substantially optimizing combustion conditions (step 250) comprises the step of reducing (step 252) the amount of oxygen available to higher-flame-speed fuel mixture 2124 in combustion chamber 2132, as shown (preferably, combustion chamber 2132 comprises at least one combustion zone of gas turbine engine 232, as shown) (at least embodying herein the step of wherein such step of substantially optimizing combustion conditions comprises the step of reducing the amount of oxygen available to such at least one higher-flame-speed fuel mixture in at least one combustion zone of such at least one gas turbine engine). Preferably, the step of substantially optimizing combustion conditions (step 250) comprises the step of controlling (step 254) the combustion temperature of higher-flame-speed fuel mixture 2124, as shown (at least embodying herein the step of wherein such step of substantially optimizing combustion conditions comprises the step of controlling the combustion temperature of such at least one higher-flame-speed fuel mixture). Preferred temperature ranges are further discussed in connection with discussions of FIG. 1.

Preferably, higher-flame-speed fuel mixture 2124 burns stably (without self-extinguishing) under low-temperature and/or low-oxygen conditions at loads between about ten percent of full load and about seventy percent of full load. Preferably, the step of injecting (step 230) comprises the step of injecting (step 231) higher-flame-speed fuel mixture 2124 into combustion chamber 2132 at part-load, as shown. Preferably, the step of injecting (step 231) comprises the step of injecting higher-flame-speed fuel mixture 2124 into combustion chamber 2132 at a throughput of about ten percent of the maximum fuel load of combustion chamber 2132 using lower-flame-speed fuel 2122 (at least embodying herein the step of wherein such step of injecting such at least one higher-flame-speed fuel mixture into such at least one gas turbine engine having such at least one pilot flame comprises the step of injecting such at least one higher-flame-speed fuel mixture into such at least one gas turbine at a throughput of about ten percent of the maximum fuel load of such at least one gas turbine engine using such at least one lower-flame-speed fuel). Preferably, the step of injecting (step 231) comprises the step of injecting higher-flame-speed fuel mixture 2124 into combustion chamber 2132 at a throughput of about twenty percent of the maximum fuel load of combustion chamber 2132 using lower-flame-speed fuel 2122 (at least embodying herein the step of wherein such step of injecting such at least one higher-flame-speed fuel mixture into such at least one gas turbine engine having such at least one pilot flame comprises the step of injecting such at least one higher-flame-speed fuel mixture into such at least one gas turbine at a throughput of about twenty percent of the maximum fuel load of such at least one gas turbine engine using such at least one lower-flame-speed fuel). Preferably, the step of injecting (step 231) comprises the step of injecting higher-flame-speed fuel mixture 2124 into combustion chamber 2132 at a throughput of about thirty percent of the maximum fuel load of combustion chamber 2132 using lower-flame-speed fuel 2122 (at least embodying herein the step of wherein such step of injecting such at least one higher-flame-speed fuel mixture into such at least one gas turbine engine having such at least one pilot flame comprises the step of injecting such at least one higher-flame-speed fuel mixture into such at least one gas turbine at a throughput of about thirty percent of the maximum fuel load of such at least one gas turbine engine using such at least one lower-flame-speed fuel). Preferably, the step of injecting (step 231) comprises the step of injecting higher-flame-speed fuel mixture 2124 into combustion chamber 2132 at a throughput of about forty percent of the maximum fuel load of combustion chamber 2132 using lower-flame-speed fuel 2122 (at least embodying herein the step of wherein such step of continuing to inject such at least one higher-flame-speed fuel mixture into such at least one gas turbine engine comprises the step of injecting such at least one higher-flame-speed fuel mixture into such at least one gas turbine engine at a throughput of about forty percent of the maximum fuel load of such at least one gas turbine engine using such at least one lower-flame-speed fuel). Upon reading the teachings of this specification, those with ordinary skill in the art will now understand that, under appropriate circumstances, considering such issues as advances in technology, user preference, type of burner, type of fuel, etc., other loads, such as fifty percent load, sixty percent load, etc., may suffice.

Figure 2A:
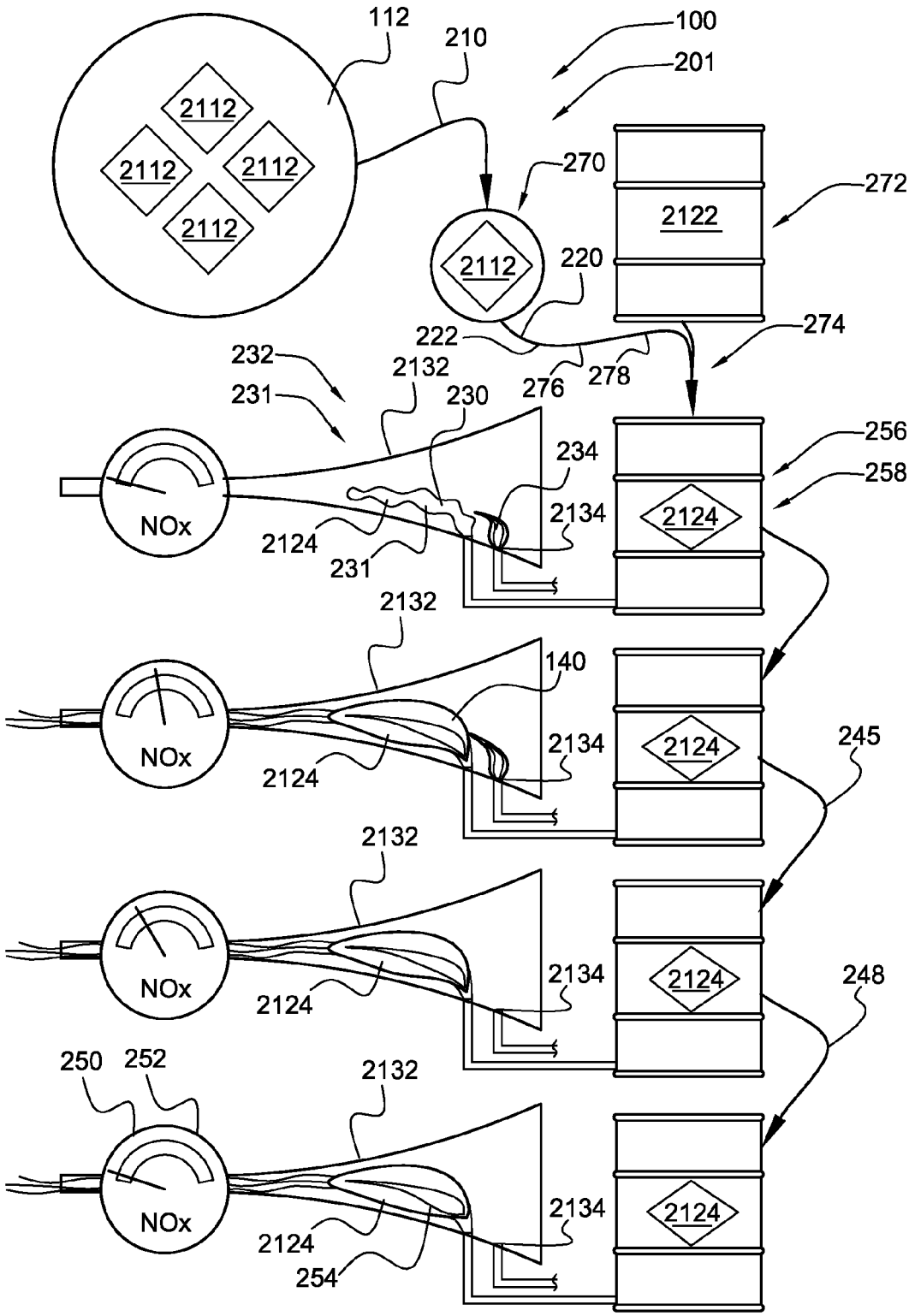
FIG. 2A shows a diagram illustrating a second combustion stabilization method according to another preferred embodiment of the present invention.
Figure 2B:
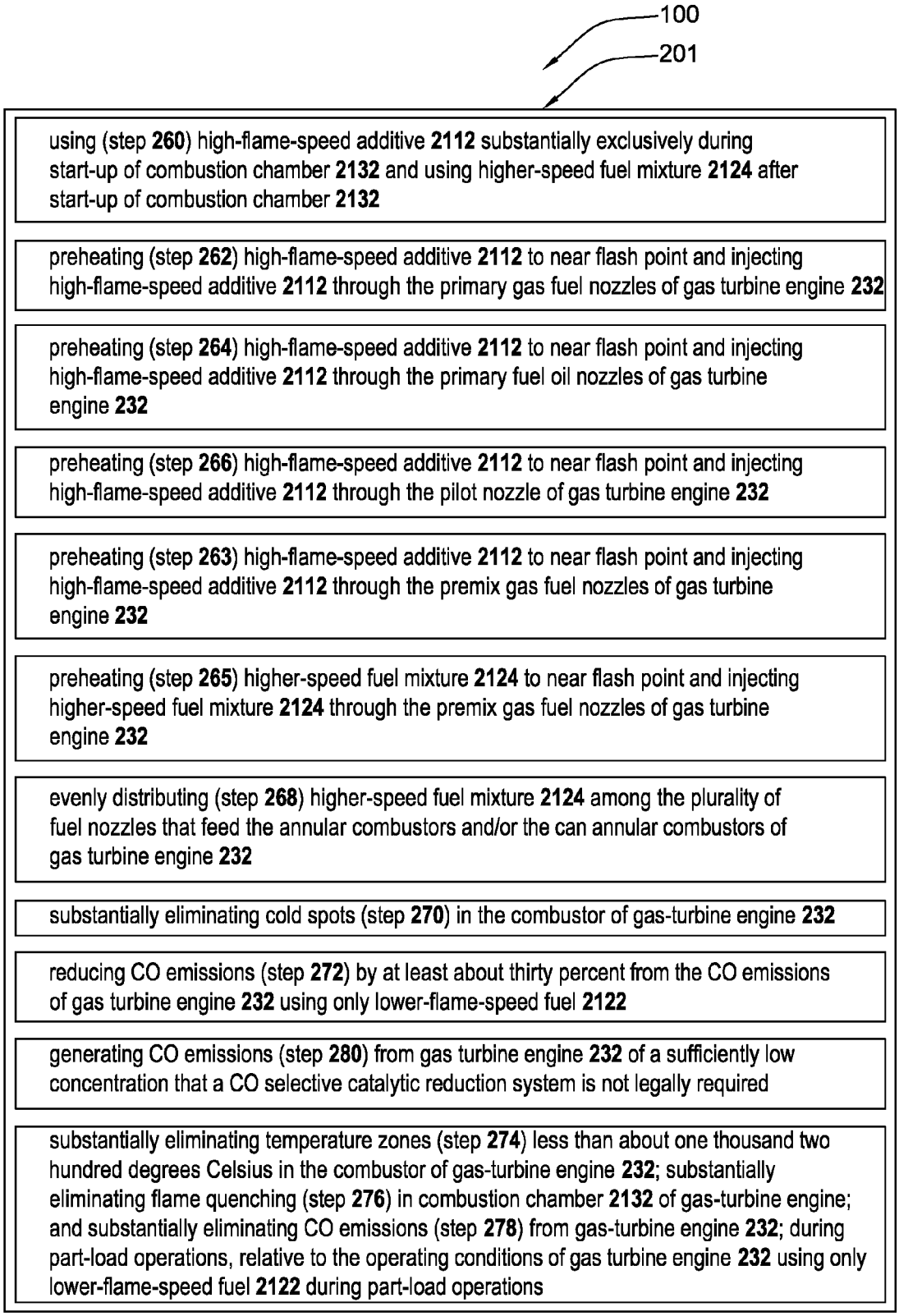
FIG. 2B shows a block diagram illustrating additional steps of the second combustion stabilization method according to FIG. 2A.

FIG. 2B shows a block diagram illustrating additional steps of second combustion stabilization method 201 according to FIG. 2A.

Preferably, combustion stabilization method 201 comprises the step of using (step 260) high-flame-speed additive 2112 substantially exclusively during start-up of combustion chamber 2132 and using higher-speed fuel mixture 2124 after start-up of combustion chamber 2132, as shown(at least embodying herein the step of using such at least one high-flame-speed additive substantially exclusively during start-up of such at least one gas turbine engine and using such at least one higher-speed fuel mixture after start-up of such at least one gas turbine engine). Preferably, high-flame-speed additive 2112 heats combustion chamber 2132 and establishes a stable flame front during start-up.

Preferably, high-flame-speed additive 2112 is preheated (step 262) to near flash point and is injected through the primary gas fuel nozzles of gas turbine engine 232, as shown (at least embodying herein the step of wherein such at least one high-flame-speed additive is preheated to near flash point and is injected through the primary gas fuel nozzles of such at least one gas turbine engine). Preferably, high-flame-speed additive 2112 is preheated (step 264) to near flash point and is injected through the primary fuel oil nozzles of gas turbine engine 232, as shown (at least embodying herein the step of wherein such at least one high-flame-speed additive is preheated to near flash point and is injected through the primary fuel oil nozzles of such at least one gas turbine engine). Preferably, high-flame-speed additive 2112 is preheated (step 266) to near flash point and is injected through the pilot nozzle of gas turbine engine 232, as shown (at least embodying herein the step of wherein such at least one high-flame-speed additive is preheated to near flash point and is injected through the pilot nozzle of such at least one gas turbine engine). Preferably, high-flame-speed additive 2112 is preheated (step 263) to near flash point and is injected through the premix gas fuel nozzles of gas turbine engine 232, as shown. Preferably, higher-speed fuel mixture 2124 is preheated (step 265) to near flash point and is injected through the premix gas fuel nozzles of gas turbine engine 232, as shown.

Preferably, the preheated high-flame-speed additive 2112 is atomized by lower-flame-speed fuel 2122 in the fuel nozzles before entering combustion chamber 2132.

Preferably, combustion stabilization method 201 comprises the step of evenly distributing (step 268) higher-speed fuel mixture 2124 among the plurality of fuel nozzles that feed the annular combustors and/or the can annular combustors of gas turbine engine 232, as shown (at least embodying herein the step of evenly distributing such at least one higher-speed fuel mixture among the plurality of fuel nozzles that feed the annular combustors and the can annular combustors of such at least one gas turbine engine). Preferably, because higher-speed fuel mixture 2124 bums with an improved stable flame, it is not necessary to fine-tune fuel distribution among the fuel nozzles in order to maintain a stable flame. Upon reading the teachings of this specification, those with ordinary skill in the art will now understand that, under appropriate circumstances, considering such issues as advances in technology, user preference, furnace conditions, fuel availability, etc., other arrangements, such as adding high-speed fuel additives to lower-speed fuels to generate higher-speed fuels that can be evenly distributed among the fuel nozzles and/or combustors at full load, etc., may suffice.

Preferably, combustion stabilization method 201 comprises the step of substantially eliminating cold spots (step 270) in the combustor of gas-turbine engine 232, as shown (at least embodying herein the step of substantially eliminating cold spots in the combustor of such at least one gas-turbine engine). Preferably, the high-flame-speed additive 2112 portion of higher-speed fuel mixture 2124 volatilizes and mixes readily with the air, resulting in a relatively homogeneous, stable flame without cold spots (under about one thousand two hundred degrees Celsius).

Preferably, combustion stabilization method 201 comprises the step of reducing CO emissions (step 272) by at least about thirty percent from the CO emissions of gas turbine engine 232 using only lower-flame-speed fuel 2122, as shown. Preferably, combustion stabilization method 201 comprises the step of generating CO emissions (step 280) from gas turbine engine 232 of a sufficiently low concentration that a CO selective catalytic reduction system is not legally required, as shown (preferably, less than or equal to about 400 parts CO per million by volume) (at least embodying herein the step of generating CO emissions from such at least one gas turbine engine of a sufficiently low concentration that a CO selective catalytic reduction system is not legally required). Preferably, the high-flame-speed additive 2112 portion of higher-speed fuel mixture 2124 volatilizes and mixes readily with the air, resulting in a relatively homogeneous, stable high-speed flame that promotes complete combustion and lowers CO emissions.

Preferably, combustion stabilization method 201 comprises the steps of: substantially eliminating temperature zones (step 274) less than about one thousand two hundred degrees Celsius in the combustor of gas-turbine engine 232; substantially eliminating flame quenching (step 276) in combustion chamber 2132 of gas-turbine engine; and substantially eliminating CO emissions (step 278) from gas-turbine engine 232; during part-load operations, as shown, relative to the operating conditions of gas turbine engine 232 using only lower-flame-speed fuel 2122 during part-load operations (at least embodying herein the steps of reducing CO emissions by at least about thirty percent from the CO emissions of such at least one gas turbine engine using only such at least one lower-flame-speed fuel; substantially eliminating temperature zones less than about one thousand two hundred degrees Celsius in the combustor of such at least one gas-turbine engine; substantially eliminating flame quenching in the combustor of such at least one gas-turbine engine; and substantially eliminating CO emissions from such at least one gas-turbine engine during part-load operations, relative to the operating conditions of such at least one gas turbine engine using only such at least one lower-flame-speed fuel during part-load operations).

Figure 3A:
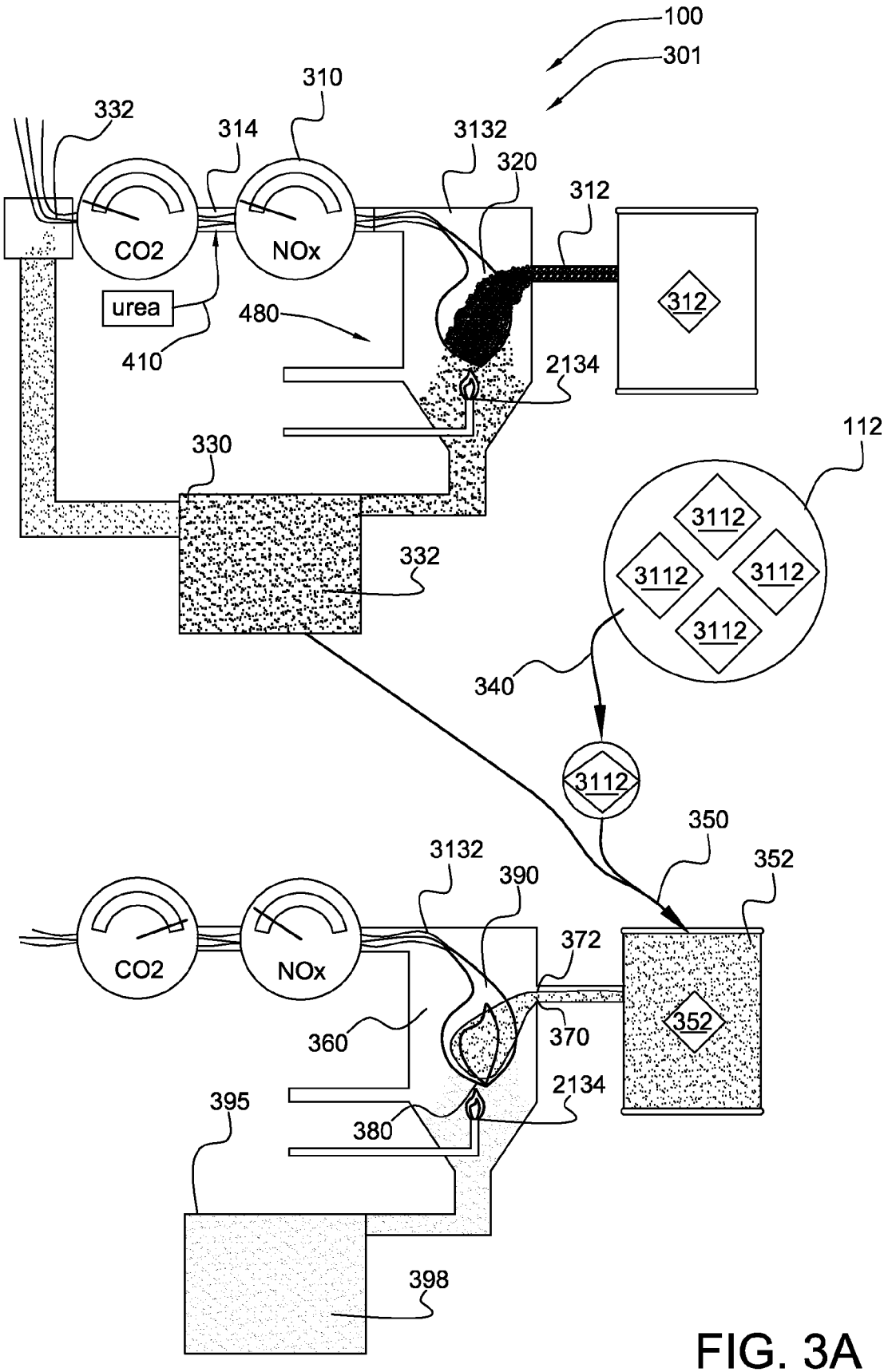
FIG. 3A shows a diagram illustrating a third combustion stabilization method according to another preferred embodiment of the present invention.

FIG. 3A shows a diagram illustrating combustion stabilization method 301 according to another preferred embodiment of the present invention. Preferably, combustion stabilization system 100 comprises combustion stabilization method 301, as shown. Preferably, combustion stabilization method 301 provides methods of minimizing NOx and CO emissions while maximizing combustion of coal in coal boilers used for electrical generation. Preferably, combustion stabilization method 301 improves flame stability under part-load, NOx-minimizing combustion conditions in coal boilers.

Preferably, high-flame-speed additive 112 comprises high-flame-speed additive 3112, as shown. Preferably, combustion chamber 132 comprises combustion chamber 3132, as shown. Preferably, combustion initiator 134 comprises combustion initiator 3134, as shown.

Preferably, combustion stabilization method 301 comprises the steps of: substantially optimizing combustion conditions (step 310) for at least one first coal fuel mixture 312 to substantially minimize NOx emissions 314; burning (step 320) first coal fuel mixture 312 under such substantially NOx minimizing conditions; collecting (step 330) at least one first coal-combustion byproduct 332 generated by such NOx-minimizing burning (step 320); selecting (step 340) at least one high-flame-speed additive 3112; adding (step 350) high-flame-speed additive 3112 to first coal-combustion byproduct 332 to generate at least one higher-flame-speed fuel mixture 352; substantially optimizing combustion conditions (step 360) for higher-flame-speed fuel mixture 352 to maximize combustion of higher-flame-speed fuel mixture 352; injecting (step 370) higher-flame-speed fuel mixture 352 into combustion chamber 3132 having combustion initiator 3134; igniting (step 380) higher-flame-speed fuel mixture 352 with combustion initiator 3134; burning (step 390) higher-flame-speed fuel mixture 352 under such substantially combustion maximizing conditions; and collecting (step 395) at least one second coal-combustion byproduct 398 generated by such combustion-maximizing burning (step 390), as shown (at least embodying herein the step of substantially optimizing combustion conditions for at least one first coal fuel mixture to substantially minimize NOx emissions; burning such at least one first coal fuel mixture under such substantially NOx minimizing conditions; collecting at least one first coal-combustion byproduct generated by such NOx-minimizing burning; adding such at least one high-flame-speed additive to such at least one first coal-combustion byproduct to generate at least one higher-flame-speed fuel mixture; substantially optimizing combustion conditions for such at least one higher-flame-speed fuel mixture to maximize combustion of such at least one higher-flame-speed fuel mixture; injecting such at least one higher-flame-speed fuel mixture into at least one combustion chamber having at least one combustion initiator; burning such at least one higher-flame-speed fuel mixture under such substantially combustion maximizing conditions; collecting at least one second coal-combustion byproduct generated by such combustion-maximizing burning). Upon reading the teachings of this specification, those with ordinary skill in the art will now understand that, under appropriate circumstances, considering such issues as advances in technology, user preference, etc., other steps, such as selling the coal combustion byproduct, extinguishing the combustion initiator, etc., may suffice.

Preferably, combustion chamber 3132 comprises coal-fired boiler 480, as shown. Preferably, coal-fired boiler 480 comprises a coal-fired electric utility boiler. Preferably, first coal fuel mixture 312 comprises coal. Preferably, first coal fuel mixture 312 comprises at least one of anthracite, bituminous coal, subbituminous coal, and lignite. Upon reading the teachings of this specification, those with ordinary skill in the art will now understand that, under appropriate circumstances, considering such issues as advances in technology, user preference, etc., other boiler fuels, such as biomass, charcoal, oil, wood, wood waste, tires, landfill materials, etc., may suffice.

Preferably, first coal-combustion byproduct 332 comprises fly ash and/or bottom ash (at least embodying herein the step of wherein such at least one first coal-combustion byproduct comprises at least one fly ash and at least one bottom ash). Preferably, burning (step 320) first coal fuel mixture 312 under such substantially NOx minimizing conditions results in low NOX emissions at the expense of incomplete combustion of first coal fuel mixture 312. Preferably, step 320 is performed under low-oxygen, full-load conditions where combustion temperatures substantially stay below the threshold for NOx formation (about twenty-eight hundred degrees Fahrenheit under these conditions). Preferably, first coal-combustion byproduct 332 is re-burned under substantially combustion maximizing conditions in step 390 resulting in substantially complete combustion of residual carbon remaining in first coal-combustion byproduct 332. Preferably, step 390 is performed under high-oxygen, part-load conditions where combustion temperatures substantially stay below the threshold for NOx formation (about twenty-seven hundred degrees Fahrenheit under these conditions). Preferably, adding (step 350) high-flame-speed additive 3112 to first coal-combustion byproduct 332 to generate at least one higher-flame-speed fuel mixture 352 stabilizes combustion of higher-flame-speed fuel mixture 352 in step 390 so that part-loads down to about ten percent of maximum load are stably combustible without self-extinguishing.

Preferably, adding (step 350) high-flame-speed additive 3112 to first coal-combustion byproduct 332 to generate at least one higher-flame-speed fuel mixture 352 also stabilizes combustion of higher-flame-speed fuel mixture 352 in step 390 so that full-loads down to about seventy percent of maximum load are stably combustible under NOx-minimizing conditions without self-extinguishing.

Preferably, first coal-combustion byproduct 332 comprises at least about five percent carbon by mass. Preferably, first coal-combustion byproduct 332 comprises at least about ten percent carbon by mass. Preferably, first coal-combustion byproduct 332 comprises at least about fifteen percent carbon by mass. Preferably, first coal-combustion byproduct 332 comprises at least about twenty percent carbon by mass.

Preferably, such step of burning (step 320) first coal fuel mixture under such substantially NOx minimizing conditions and such step of burning (step 390) higher-flame-speed fuel mixture 352 under such substantially combustion maximizing conditions both occur in combustion chamber 3132 at different times(at least embodying herein the step of wherein such step of burning such at least one first coal fuel mixture under such substantially NOx minimizing conditions and such step of burning such at least one higher-flame-speed fuel mixture under such substantially combustion maximizing conditions both occur in such at least one combustion chamber at different times). Preferably, the step of burning (step 320) first coal fuel mixture 312 under such substantially NOx minimizing conditions occurs during substantially high-load (between about seventy percent and about one hundred percent of maximum load) operations of combustion chamber 3132 and such step of burning (step 390) higher-flame-speed fuel mixture 352 under such substantially combustion maximizing conditions occurs during part-load (below about seventy percent of maximum load) conditions of combustion chamber 3132 (at least embodying herein the step of wherein the step of burning such at least one first coal fuel mixture under such substantially NOx minimizing conditions occurs during substantially high-load (between about 70% and about 100% of maximum load) operations of such at least one at least one combustion chamber and such step of burning such at least one higher-flame-speed fuel mixture under such substantially combustion maximizing conditions occurs during part-load (below about 70% of maximum load) conditions of such at least one combustion chamber). Preferably, such step of injecting (step 370) higher-flame-speed fuel mixture 352 into combustion chamber 3132 having combustion initiator 3134 comprises the step of injecting (step 372) at least one part-load of higher-flame-speed fuel mixture 352 into combustion chamber 3132 having combustion initiator 3134, as shown.

Preferably, burning (step 320) first coal fuel mixture under such substantially NOx minimizing conditions occurs during full-load conditions. Preferably, burning (step 320) first coal fuel mixture under such substantially NOx minimizing conditions occurs during daytime—peak demand for power. Most preferably, burning (step 320) first coal fuel mixture under such substantially NOx minimizing conditions occurs during peak electricity demand hours. Preferably, burning (step 390) higher-flame-speed fuel mixture 352 under such substantially combustion maximizing conditions occurs under part-load conditions. Preferably, burning (step 390) higher-flame-speed fuel mixture 352 under such substantially combustion maximizing conditions occurs during night-time—off peak hours. Most preferably, burning (step 390) higher-flame-speed fuel mixture 352 under such substantially combustion maximizing conditions occurs during non-peak electricity demand hours.

Figure 3B:
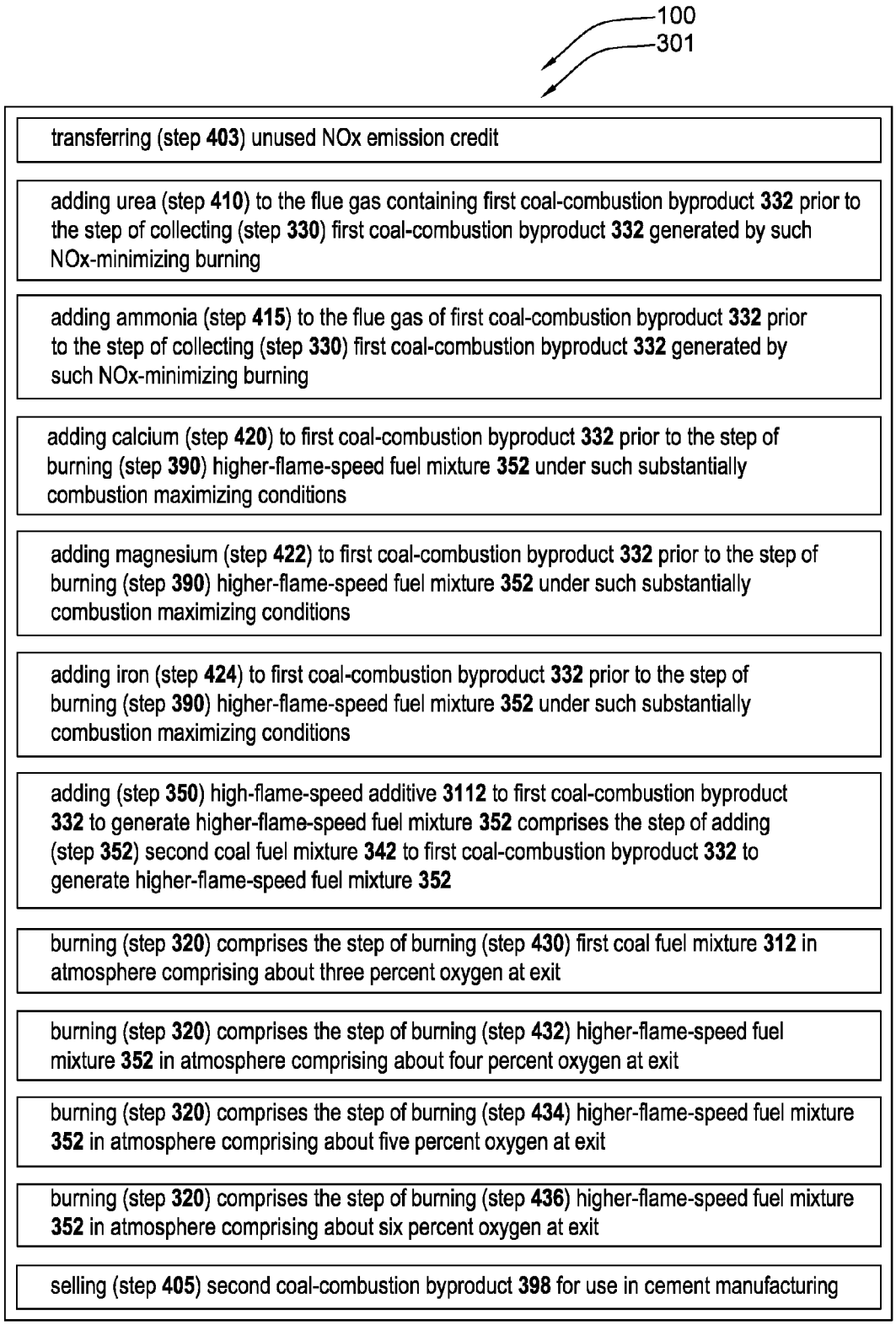
FIG. 3B shows a block diagram illustrating additional steps of the third combustion stabilization method according to FIG. 3A.

FIG. 3B shows a block diagram illustrating additional steps of third combustion stabilization method 301 according to FIG. 3A.

Preferably, combustion stabilization method 301 comprises the step of transferring (step 403) unused NOx emission credit, as shown (at least embodying herein the step of transferring at least one unused NOx emission credit). Preferably, NOx emissions credits achieved through combustion stabilization method 3101, combustion stabilization method 201, and/or combustion stabilization method 301 are sold and/or transferred to companies needing NOx emissions credits.

Preferably, combustion stabilization method 301 comprises the step of adding urea (step 410) to the flue gas containing first coal-combustion byproduct 332 to reduce NOx emissions prior to the step of collecting (step 330) first coal-combustion byproduct 332 generated by such NOx-minimizing burning, as shown (at least embodying herein the step of adding urea to such at least one first coal-combustion byproduct prior to the step of collecting such at least one first coal-combustion byproduct generated by such NOx-minimizing burning). Preferably, combustion stabilization method 301 comprises the step of adding ammonia (step 415) to the flue gas of first coal-combustion byproduct 332 to reduce NOx emissions prior to the step of collecting (step 330) first coal-combustion byproduct 332 generated by such NOx-minimizing burning, as shown (at least embodying herein the step of adding ammonia to such at least one first coal-combustion byproduct prior to the step of collecting such at least one first coal-combustion byproduct generated by such NOx-minimizing burning). Preferably, adding urea and/or ammonia to the flue gas at the exit of the boiler reduces NOx emissions.

Preferably, combustion stabilization method 301 comprises the step of adding calcium (step 420) to first coal-combustion byproduct 332 prior to the step of burning (step 390) higher-flame-speed fuel mixture 352 under such substantially combustion maximizing conditions, as shown (at least embodying herein the step of adding calcium to such at least one first coal-combustion byproduct prior to the step of burning such at least one higher-flame-speed fuel mixture under such substantially combustion maximizing conditions). Preferably, combustion stabilization method 301 comprises the step of adding magnesium (step 422) to first coal-combustion byproduct 332 prior to the step of burning (step 390) higher-flame-speed fuel mixture 352 under such substantially combustion maximizing conditions, as shown, to generate high quality ash (at least embodying herein the step of adding magnesium to such at least one first coal-combustion byproduct prior to the step of burning such at least one higher-flame-speed fuel mixture under such substantially combustion maximizing conditions). Preferably, combustion stabilization method 301 comprises the step of adding iron (step 424) to first coal-combustion byproduct 332 prior to the step of burning (step 390) higher-flame-speed fuel mixture 352 under such substantially combustion maximizing conditions, as shown, to generate the ideal ash composition for cement applications (at least embodying herein the step of adding iron to such at least one first coal-combustion byproduct prior to the step of burning such at least one higher-flame-speed fuel mixture under such substantially combustion maximizing conditions). Preferably, second coal-combustion byproduct 398 comprises low-carbon ash suitable for use in cement manufacturing. Preferably, adding controlled amounts of calcium, magnesium, and/or iron improves the function of second coal-combustion byproduct 398 used to manufacture cement.

Preferably, such step of selecting (step 340) high-flame-speed additive 3112 comprises the step of selecting (step 344) at least one hydrocarbon, as shown. Preferably, such step of selecting (step 344) at least one hydrocarbon comprises the step of selecting at least one member of the set preferably comprising methane, alternately preferably selecting ethane, alternately preferably selecting propane, alternately preferably selecting butanes, alternately preferably selecting pentanes, alternately preferably selecting hexanes, alternately preferably selecting septanes, alternately preferably selecting octanes, alternately preferably selecting nonanes, alternately preferably selecting decanes, alternately preferably selecting toluene, alternately preferably selecting benzene, alternately preferably selecting acetone, alternately preferably selecting mixtures of hydrocarbons where $C<10$, alternately preferably selecting mixtures of hydrocarbons where $C<20$, alternately preferably selecting diesel oil, alternately preferably selecting no. 2 oil, alternately preferably selecting heavy oil, alternately preferably selecting jet fuel, alternately preferably selecting acetylene, alternately preferably selecting bio-derived oils, alternately preferably selecting naphta, alternately preferably selecting coal gasification products, and alternately preferably selecting oil gasification products. Preferably, such step of selecting (step 344) at least one hydrocarbon comprises the step of selecting at least one member of the set preferably comprising alcohols, alternately preferably selecting ethers, alternately preferably selecting aldehydes, and alternately preferably selecting ketones. Preferably, such step of selecting (step 340) high-flame-speed additive comprises the step of selecting hydrogen. Upon reading the teachings of this specification, those with ordinary skill in the art will now understand that, under appropriate circumstances, considering such issues as advances in technology, user preference, etc., other high-flame-speed additives, such as oxygen, hydrogen peroxide, nitrous oxide, etc., may suffice.

Preferably, the step of selecting (step 340) high-flame-speed additive 3112 comprises the step of selecting at least one second coal fuel mixture 342, as shown (at least embodying herein the step of wherein the step of selecting at least one high-flame-speed additive comprises the step of selecting at least one second coal fuel mixture). Preferably, the step of adding (step 350) high-flame-speed additive 3112 to first coal-combustion byproduct 332 to generate higher-flame-speed fuel mixture 352 comprises the step of adding (step 352) second coal fuel mixture 342 to first coal-combustion byproduct 332 to generate higher-flame-speed fuel mixture 352, as shown (at least embodying herein the step of wherein the step of adding such at least one high-flame-speed additive to such at least one first coal-combustion byproduct to generate at least one higher-flame-speed fuel mixture comprises the step of adding such at least one second coal fuel mixture to such at least one first coal-combustion byproduct to generate at least one higher-flame-speed fuel mixture). Preferably, second coal fuel mixture 342 is a high-flame-speed additive 3112 relative to first coal-combustion byproduct 332. Preferably, second coal fuel mixture 342 is added to first coal-combustion byproduct 332 to generate higher-flame-speed fuel mixture 352.

Preferably, first coal-combustion byproduct 332 and high-flame-speed additive 3112 (preferably comprising second coal fuel mixture 342) comprise about 1:10 ratio or less by mass, preferably about 1.5:10 ratio by mass, preferably about 2:10 ratio by mass, preferably about 2.5:10 ratio by mass, preferably about 3:10 ratio by mass, preferably about 3.5:10 ratio by mass, preferably about 4:10 ratio by mass, or preferably about 4.5:10 ratio by mass. Upon reading the teachings of this specification, those with ordinary skill in the art will now understand that, under appropriate circumstances, considering such issues as advances in technology, user preference, etc., other ratios, such as 31:100, 50:100, 75:100, etc., may suffice.

Preferably, substantially NOx minimizing conditions comprise limited-oxygen conditions adapted to reduce flame temperatures below about twenty-eight hundred degrees Fahrenheit, which also create low oxygen, fuel rich conditions near the fuel nozzle exit. Preferably, such step of burning (step 320) first coal fuel mixture 312 under such substantially NOx minimizing conditions comprises the step of burning (step 430) first coal fuel mixture 312 in atmosphere comprising about three percent oxygen at exit, as shown. Preferably, such step of burning (step 320) comprises the step of burning (step 432) higher-flame-speed fuel mixture 352 in atmosphere comprising about four percent oxygen at exit, as shown. Preferably, such step of burning (step 320) comprises the step of burning (step 434) higher-flame-speed fuel mixture 352 in atmosphere comprising about five percent oxygen at exit, as shown. Preferably, such step of burning (step 320) comprises the step of burning (step 436) higher-flame-speed fuel mixture 352 in atmosphere comprising about six percent oxygen at exit, as shown.

Preferably, second coal-combustion byproduct 398 comprises low-carbon ash suitable for use in cement manufacturing. Preferably, combustion stabilization method 301 comprises the step of selling (step 405) second coal-combustion byproduct 398 for use in cement manufacturing, as shown(at least embodying herein the step of selling such at least one second coal-combustion byproduct for use in cement manufacturing). Preferably, second coal-combustion byproduct 398 comprises less than about five percent carbon by mass, preferably less than about four percent carbon by mass, preferably less than about three percent carbon by mass, preferably less than about two percent carbon by mass, preferably less than about one percent carbon by mass.

Figure 3C:
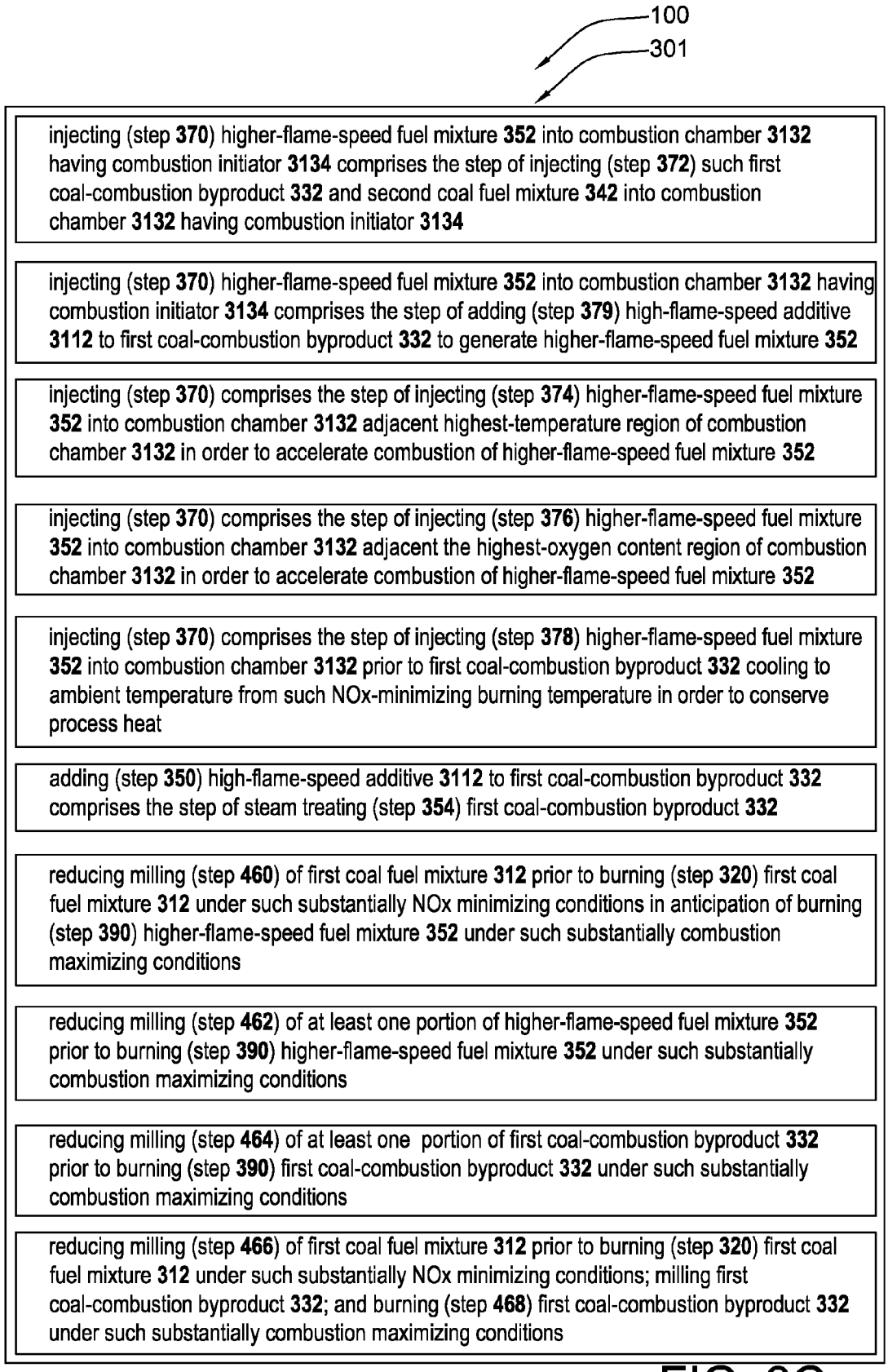
FIG. 3C shows another block diagram illustrating additional steps of the third combustion stabilization method according to FIG. 3A.

FIG. 3C shows another block diagram illustrating additional steps of third combustion stabilization method 301 according to FIG. 3A.

Preferably, the step of injecting (step 370) higher-flame-speed fuel mixture 352 into combustion chamber 3132 having combustion initiator 3134 comprises the step of injecting (step 372) such first coal-combustion byproduct 332 and second coal fuel mixture 342 into combustion chamber 3132 having combustion initiator 3134, as shown (at least embodying herein the step of wherein the step of injecting such at least one higher-flame-speed fuel mixture into such at least one combustion chamber having such at least one combustion initiator comprises the step of injecting such at least one first coal-combustion byproduct and such at least one second coal fuel mixture into such at least one combustion chamber having such at least one combustion initiator). Preferably, such step of injecting (step 370) higher-flame-speed fuel mixture 352 into combustion chamber 3132 having combustion initiator 3134 comprises the step of adding (step 379) high-flame-speed additive 3112 to first coal-combustion byproduct 332 to generate higher-flame-speed fuel mixture 352, as shown (at least embodying herein wherein such step of injecting such at least one higher-flame-speed fuel mixture into such at least one combustion chamber having such at least one combustion initiator comprises the step of adding such at least one high-flame-speed additive to such at least one first coal-combustion byproduct to generate at least one higher-flame-speed fuel mixture). Preferably, higher-flame-speed fuel mixture 352 is blended prior to milling.

Preferably, such step of injecting (step 370) higher-flame-speed fuel mixture 352 into combustion chamber 3132 having combustion initiator 3134 comprises the step of injecting (step 374) higher-flame-speed fuel mixture 352 into combustion chamber 3132 adjacent highest-temperature region of combustion chamber 3132, as shown, in order to accelerate combustion of higher-flame-speed fuel mixture 352 (at least embodying herein the step of wherein such step of injecting such at least one higher-flame-speed fuel mixture into such at least one combustion chamber having such at least one combustion initiator comprises the step of injecting such at least one higher-flame-speed fuel mixture into such at least one combustion chamber adjacent at least one highest-temperature region of such at least one combustion chamber). Preferably, such step of injecting (step 370) comprises the step of injecting (step 376) higher-flame-speed fuel mixture 352 into combustion chamber 3132 adjacent the highest-oxygen content region of combustion chamber 3132, as shown, in order to accelerate combustion of higher-flame-speed fuel mixture 352 (at least embodying herein the step of wherein such step of injecting such at least one higher-flame-speed fuel mixture into such at least one combustion chamber having such at least one combustion initiator comprises the step of injecting such at least one higher-flame-speed fuel mixture into such at least one combustion chamber adjacent at least one highest-oxygen content region of such at least one combustion chamber). Preferably, such step of injecting (step 370) comprises the step of injecting (step 378) higher-flame-speed fuel mixture 352 into combustion chamber 3132 prior to first coal-combustion byproduct 332 cooling to ambient temperature from such NOx-minimizing burning temperature, as shown, in order to conserve process heat (at least embodying herein the step of wherein such step of injecting such at least one higher-flame-speed fuel mixture into such at least one combustion chamber having such at least one combustion initiator comprises the step of injecting such at least one higher-flame-speed fuel mixture into such at least one combustion chamber prior to such at least one first coal-combustion byproduct cooling to ambient temperature from such NOx-minimizing burning temperature).

Preferably, combustion stabilization method 301 comprises the step of steam treating (step 354) first coal-combustion byproduct 332 in order to open up pores to facilitate combustion (at least embodying herein the step of steam treating such at least one first coal-combustion byproduct). Preferably, adding (step 350) high-flame-speed additive 3112 to first coal-combustion byproduct 332 comprises the step of steam treating (step 354) first coal-combustion byproduct 332, as shown (at least embodying herein the step of wherein such step of adding such at least one high-flame-speed additive to such at least one first coal-combustion byproduct comprises the step of steam treating such at least one first coal-combustion byproduct).

Preferably, reducing milling of first coal fuel mixture 312 conserves electricity and decreases wear on milling equipment. Preferably, combustion stabilization method 301 permits complete combustion of relatively large pieces of first coal fuel mixture 312, decreasing the necessity for milling first coal fuel mixture 312 into small pieces prior to burning (step 320). Preferably, first coal fuel mixture 312 is used as received at the coal boiler from the supplier without any additional milling. Preferably, combustion stabilization method 301 comprises the step of reducing milling (step 460) of first coal fuel mixture 312 prior to burning (step 320) first coal fuel mixture 312 under such substantially NOx minimizing conditions in anticipation of burning (step 390) higher-flame-speed fuel mixture 352 under such substantially combustion maximizing conditions, as shown (at least embodying herein the step of reducing milling of such at least one first coal fuel mixture prior to burning such at least one first coal fuel mixture under such substantially NOx minimizing conditions in anticipation of burning such at least one higher-flame-speed fuel mixture under such substantially combustion maximizing conditions).

Preferably, reducing the power needs for milling of higher-flame-speed fuel mixture 352 conserves electricity and decreases wear on milling equipment. Preferably, combustion stabilization method 301 comprises the step of reducing milling (step 462) of at least one portion of higher-flame-speed fuel mixture 352 prior to burning (step 390) higher-flame-speed fuel mixture 352 under such substantially combustion maximizing conditions, as shown (at least embodying herein the step of reducing milling of at least one portion of such at least one higher-flame-speed fuel mixture prior to burning such at least one higher-flame-speed fuel mixture under such substantially combustion maximizing conditions). Preferably, higher-flame-speed fuel mixture 352 is milled after high-flame-speed additive 3112 and first coal-combustion byproduct 332 are added together, resulting in an overall reduction in milling.

Preferably, reducing milling of first coal-combustion byproduct 332 conserves electricity and decreases wear on milling equipment. Preferably, combustion stabilization method 301 comprises the step of reducing milling (step 464) of at least one portion of first coal-combustion byproduct 332 prior to burning (step 390) first coal-combustion byproduct 332 under such substantially combustion maximizing conditions, as shown (at least embodying herein the step of reducing milling of at least one portion of such at least one first coal-combustion byproduct prior to burning such at least one first coal-combustion byproduct under such substantially combustion maximizing conditions).

Preferably, milling first coal-combustion byproduct 332 instead of milling first coal fuel mixture 312 conserves electricity and decreases wear on milling equipment because first coal-combustion byproduct 332 is easier to mill than first coal fuel mixture 312. Preferably, combustion stabilization method 301 comprises the steps of: reducing milling (step 466) of first coal fuel mixture 312 prior to burning (step 320) first coal fuel mixture 312 under such substantially NOx minimizing conditions; milling first coal-combustion byproduct 332; and burning (step 468) first coal-combustion byproduct 332 under such substantially combustion maximizing conditions, as shown. Preferably, utilizing step 466 and step 468 reduces mill electrical consumption by about twenty percent per ton of first coal fuel mixture 312.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A combustion stabilization system, relating to improving flame stability under NOx-minimizing combustion conditions, comprising the steps of:

a) selecting at least one high-flame-speed additive;

b) preheating such at least one high-flame-speed additive;

c) adding such at least one high-flame-speed additive to at least one lower-flame-speed fuel to generate at least one higher-flame-speed fuel mixture;

d) injecting at least one part-load of such at least one higher-flame-speed fuel mixture into at least one combustion chamber having at least one combustion initiator;

e) igniting such at least one higher-flame-speed fuel mixture with such at least one combustion initiator; and f) substantially optimizing combustion conditions for such at least one higher-flame-speed fuel mixture to substantially minimize NOx emissions.

2. The combustion stabilization system, according to claim 1, wherein such at least one high-flame-speed additive is preheated to near flash point.

3. The combustion stabilization system, according to claim 1, wherein such at least one high-flame-speed additive is preheated to above flash point.

4. A combustion stabilization system, relating to improving flame stability under NOx-minimizing combustion conditions, comprising the steps of:

a) selecting at least one high-flame-speed additive;

b) preheating such at least one high-flame-speed additive;

c) adding such at least one high-flame-speed additive to at least one lower-flame-speed fuel to generate at least one higher-flame-speed fuel mixture;

d) injecting such at least one higher-flame-speed fuel mixture into at least one gas turbine engine;

e) igniting such at least one higher-flame-speed fuel mixture;

f);

g) continuing to inject such at least one higher-flame-speed fuel mixture into such at least one gas turbine engine; and h) substantially optimizing combustion conditions for such at least one higher-flame-speed fuel mixture to substantially minimize NOx emissions i).

5. The combustion stabilization system, according to claim 4, wherein such step of injecting such at least one higher-flame-speed fuel mixture into at least one gas turbine engine comprises the step of injecting at least one part-load of such at least one higher-flame-speed fuel mixture into at least one gas turbine engine.

6. The combustion stabilization system, according to claim 4, wherein said step of preheating such at least one high-flame-speed additive is conducted prior to adding such at least one high-flame-speed additive to such at least one lower-flame-speed fuel to generate such at least one higher-flame-speed fuel mixture.

7. The combustion stabilization system, according to claim 4, further comprising the step of preheating such at least one lower-flame-speed fuel prior to adding such at least one high-flame-speed additive to such at least one lower-flame-speed fuel to generate such at least one higher-flame-speed fuel mixture.

8. The combustion stabilization system, according to claim 7, wherein the step of preheating such at least one high-flame-speed additive is conducted prior to adding such at least one high-flame-speed additive to such at least one preheated lower-flame-speed fuel.

9. The combustion stabilization system, according to claim 4, further comprising the step of atomizing such at least one high-flame-speed additive prior to adding such at least one high-flame-speed additive to such at least one lower-flame-speed fuel to generate such at least one higher-flame-speed fuel mixture.

10. The combustion stabilization system, according to claim 4, further comprising the step of vaporizing such at least one high-flame-speed additive prior to adding such at least one high-flame-speed additive to such at least one lower-flame-speed fuel to generate such at least one higher-flame-speed fuel mixture.

11. The combustion stabilization system, according to claim 4, wherein said step of adding such at least one high-flame-speed additive to such at least one lower-flame-speed fuel further comprises the step of increasing the flame speed of such at least one higher-flame-speed fuel mixture by about thirty percent relative to the flame speed of such at least one lower-flame-speed fuel.

12. The combustion stabilization system, according to claim 4, wherein said step of substantially optimizing combustion conditions comprises the step of reducing the amount of oxygen available to such at least one higher-flame-speed fuel mixture in at least one combustion zone of such at least one gas turbine engine.

13. The combustion stabilization system, according to claim 4, wherein said step of substantially optimizing combustion conditions comprises the step of controlling the combustion temperature of such at least one higher-flame-speed fuel mixture.

14. The combustion stabilization system, according to claim 4, wherein such step of selecting at least one high-flame-speed additive comprises the step of selecting at least one hydrocarbon.

15. The combustion stabilization system, according to claim 14, wherein such step of selecting at least one hydrocarbon comprises the step of selecting at least one of the set comprising methane, ethane, propane, butanes, pentanes, hexanes, septanes, octanes, nonanes, decanes, toluene, benzene, acetone, mixtures of hydrocarbons where C<10, mixtures of hydrocarbons where C<20, diesel oil, no. 2 oil, jet fuel, acetylene, bio derived oils, naphta, coal-based gasification products, and oil-based gasification products.

16. The combustion stabilization system, according to claim 14, wherein such step of selecting at least one hydrocarbon comprises the step of selecting at least one of the set comprising alcohols, ethers, aldehydes, and ketones.

17. The combustion stabilization system, according to claim 4, wherein such step of selecting at least one high-flame-speed additive comprises the step of selecting hydrogen.

18. The combustion stabilization system, according to claim 4, wherein such step of injecting such at least one higher-flame-speed fuel mixture into such at least one gas turbine engine comprises the step of injecting such at least one higher-flame-speed fuel mixture into such at least one gas turbine at a throughput of about ten percent of the maximum fuel load of such at least one gas turbine engine using such at least one lower-flame-speed fuel.

19. The combustion stabilization system, according to claim 4, wherein such step of injecting such at least one higher-flame-speed fuel mixture into such at least one gas turbine engine comprises the step of injecting such at least one higher-flame-speed fuel mixture into such at least one gas turbine at a throughput of about twenty percent of the maximum fuel load of such at least one gas turbine engine using such at least one lower-flame-speed fuel.

20. The combustion stabilization system, according to claim 4, wherein such step of injecting such at least one higher-flame-speed fuel mixture into such at least one gas turbine engine comprises the step of injecting such at least one higher-flame-speed fuel mixture into such at least one gas turbine at a throughput of about thirty percent of the maximum fuel load of such at least one gas turbine engine using such at least one lower-flame-speed fuel.

21. The combustion stabilization system, according to claim 4, wherein such step of continuing to inject such at least one higher-flame-speed fuel mixture into such at least one gas turbine engine comprises the step of injecting such at least one higher-flame-speed fuel mixture into such at least one gas turbine engine at a throughput of about forty percent of the maximum fuel load of such at least one gas turbine engine using such at least one lower-flame-speed fuel.

22. The combustion stabilization system, according to claim 4, further comprising the step of preheating such at least one higher-flame-speed fuel mixture to near the flash point of such at least one high-flame-speed additive prior to injecting such at least one higher-flame-speed fuel mixture into such at least one gas turbine engine, whereby such at least one high-flame-speed additive atomizes such at least one high-flame-speed fuel during injection.

23. The combustion stabilization system, according to claim 4, wherein the step of preheating such at least one high-flame-speed additive is conducted to near the flash point of such at least one high-flame-speed additive prior to continuing to inject such at least one higher-flame-speed fuel mixture into such at least one gas turbine engine, whereby such at least one high-flame-speed additive atomizes such at least one higher-flame-speed fuel during injection.

24. The combustion stabilization system, according to claim 4, further comprising the step of using such at least one high-flame-speed additive substantially exclusively during start-up of such at least one gas turbine engine and using such at least one higher-speed fuel mixture after start-up of such at least one gas turbine engine.

25. The combustion stabilization system, according to claim 4, wherein such at least one high-flame-speed additive is preheated to near flash point and is injected through the primary gas fuel nozzles of such at least one gas turbine engine.

26. The combustion stabilization system, according to claim 4, wherein such at least one high-flame-speed additive is preheated to near flash point and is injected through at least one primary fuel oil nozzle of such at least one gas turbine engine.

27. The combustion stabilization system, according to claim 4, wherein such at least one high-flame-speed additive is preheated to near flash point and is injected through at least one pilot nozzle of such at least one gas turbine engine.

28. The combustion stabilization system, according to claim 4, wherein such at least one high-flame-speed additive is preheated to near flash point and is injected through at least one premix gas fuel nozzle of such at least one gas turbine engine.

29. The combustion stabilization system, according to claim 4, wherein such at least one higher-flame-speed fuel is preheated to near flash point and is injected through at least one premix gas fuel nozzle of such at least one gas turbine engine.

30. The combustion stabilization system, according to claim 4, further comprising the step of evenly distributing such at least one higher-speed fuel mixture among at least one plurality of fuel nozzles that feed at least one annular combustor and at least one can annular combustor of such at least one gas turbine engine.

31. The combustion stabilization system, according to claim 4, further comprising the step of substantially eliminating cold spots in the combustor of such at least one gas-turbine engine.

32. The combustion stabilization system, according to claim 4, further comprising the step of reducing CO emissions by at least about thirty percent from the CO emissions of such at least one gas turbine engine using only such at least one lower-flame-speed fuel.

33. The combustion stabilization system, according to claim 4, further comprising the steps of:

a) substantially eliminating temperature zones less than about one thousand two hundred degrees Celsius in the combustor of such at least one gas-turbine engine;
b) substantially eliminating flame quenching in the combustor of such at least one gas-turbine engine; and
c) substantially eliminating CO emissions from such at least one gas-turbine engine during part-load operations, relative to the operating conditions of such at least one gas turbine engine using only such at least one lower-flame-speed fuel during part-load operations.

34. The combustion stabilization system, according to claim 4, further comprising the step of generating CO emissions from such at least one gas turbine engine of a sufficiently low concentration that a CO selective catalytic reduction system is not legally required.

35. The combustion stabilization system, according to claim 4, wherein such at least one high-flame-speed additive is preheated to near flash point.

36. The combustion stabilization system, according to claim 4, wherein such at least one high-flame-speed additive is preheated to above flash point.

37. A combustion stabilization system, relating to improving flame stability under NOx-minimizing combustion conditions, comprising the steps of:

a) selecting at least one coal-combustion byproduct;
b) selecting at least one high-flame-speed additive;
c) preheating such at least one high-flame-speed additive;
d) adding such at least one high-flame-speed additive to the at least one coal-combustion byproduct to generate at least one higher-flame-speed fuel mixture;
e) injecting at least one part-load of such at least one higher-flame-speed fuel mixture into at least one combustion chamber having at least one combustion initiator;
f) igniting such at least one higher-flame-speed fuel mixture with such at least one combustion initiator; and
g) substantially optimizing combustion conditions for such at least one higher-flame-speed fuel mixture to substantially minimize NOx emissions.

38. The combustion stabilization system, according to claim 37, further comprising the step of adding urea to such at least one coal-combustion byproduct.

39. The combustion stabilization system, according to claim 37, further comprising the step of adding ammonia to such at least one coal-combustion byproduct.

40. The combustion stabilization system, according to claim 37, further comprising the step of adding calcium to such at least one coal-combustion byproduct prior to the step of igniting such at least one higher-flame-speed fuel mixture.

41. The combustion stabilization system, according to claim 37, further comprising the step of adding magnesium to such at least one coal-combustion byproduct prior to the step of igniting such at least one higher-flame-speed fuel mixture.

42. The combustion stabilization system, according to claim 37, further comprising the step of adding iron to such at least one coal-combustion byproduct prior to the step of igniting such at least one higher-flame-speed fuel mixture.

43. A combustion stabilization system, relating to improving flame stability under NOx-minimizing combustion conditions, comprising the steps of:

a) selecting at least one coal-combustion byproduct;
b) selecting at least one high-flame-speed additive;
c) preheating such at least one high-flame-speed additive;
d) adding such at least one high-flame-speed additive to at least one coal-combustion byproduct to generate at least one higher-flame-speed fuel mixture;
e) injecting such at least one higher-flame-speed fuel mixture into at least one gas turbine engine;
f) igniting such at least one higher-flame-speed fuel mixture;
g) continuing to inject such at least one part-load of such at least one higher-flame-speed fuel mixture into such at least one gas turbine engine; and
h) substantially optimizing combustion conditions for such at least one higher-flame-speed fuel mixture to substantially minimize NOx emissions.

44. The combustion stabilization system, according to claim 43, further comprising the step of adding urea to such at least one coal-combustion byproduct.

45. The combustion stabilization system, according to claim 43, further comprising the step of adding ammonia to such at least one coal-combustion byproduct.

46. The combustion stabilization system, according to claim 43, further comprising the step of adding calcium to such at least one coal-combustion byproduct prior to the step of igniting such at least one higher-flame-speed fuel mixture.

47. The combustion stabilization system, according to claim 43, further comprising the step of adding magnesium to such at least one coal-combustion byproduct prior to the step of igniting such at least one higher-flame-speed fuel mixture.

48. The combustion stabilization system, according to claim 43, further comprising the step of adding iron to such at least one coal-combustion byproduct prior to the step of igniting such at least one higher-flame-speed fuel mixture.

49. A combustion stabilization system, relating to improving flame stability under NOx minimizing combustion conditions, comprising the steps of:

a) selecting at least one high-flame-speed additive;
b) adding such at least one high-flame-speed additive to at least one lower-flame-speed fuel to generate at least one higher-flame-speed fuel mixture;
c) injecting such at least one higher-flame-speed fuel mixture into at least one gas turbine engine;
d) igniting such at least one higher-speed fuel mixture;
e) continuing to inject such at least one part-load of such at least one higher-flame-speed fuel mixture into such at least one gas turbine engine; and
f) substantially optimizing combustion conditions for such at least one higher-flame-speed fuel mixture to substantially minimize NOx emissions;
g) substantially eliminating temperature zones less than about one thousand two hundred degrees Celsius in the combustor of such at least one gas-turbine engine;

h) substantially eliminating flame quenching in the combustor of such at least one gas turbine engine; and i) substantially eliminating CO emissions from such at least one gas-turbine engine during part-load operations, relative to the operating conditions of such at least one gas turbine engine using only such at least one lower-flame-speed fuel during part-load operations.

* * * * *